United States Patent [19]

Kaneko et al.

[11] Patent Number: 4,495,982

[45] Date of Patent: Jan. 29, 1985

[54] HORIZONTAL CONTINUOUS CASTING METHOD

[75] Inventors: Hideo Kaneko; Hatuyoshi Kumashiro; Akira Iwata, all of Kobe, Japan

[73] Assignee: Kawasaki Jukogyo Kabushiki Kaisha, Kobe, Japan

[21] Appl. No.: 441,704

[22] Filed: Nov. 15, 1982

[30] Foreign Application Priority Data

| | | | |
|---|---|---|---|
| Nov. 18, 1981 | [JP] | Japan | 56-185880 |
| Nov. 18, 1981 | [JP] | Japan | 56-185881 |
| Nov. 18, 1981 | [JP] | Japan | 56-185882 |

[51] Int. Cl.[3] ..... B22D 11/10; B22D 11/16

[52] U.S. Cl. ..... 164/452; 164/466; 164/490

[58] Field of Search ..... 164/466, 467, 488, 490, 164/502, 505, 440, 439, 449, 452, 453

[56] References Cited

U.S. PATENT DOCUMENTS

| | | | |
|---|---|---|---|
| 3,287,773 | 11/1966 | Woodburn, Jr. | 164/452 |
| 3,630,266 | 12/1971 | Watts | 164/452 |
| 3,783,932 | 1/1974 | Crowell et al. | 164/452 |
| 3,842,894 | 10/1974 | Southworth et al. | 164/449 X |
| 3,987,840 | 10/1976 | Birat | 164/466 |
| 4,146,078 | 3/1979 | Rummel et al. | 164/490 X |
| 4,450,892 | 5/1984 | Heinemann et al. | 164/467 |

FOREIGN PATENT DOCUMENTS

| | | | |
|---|---|---|---|
| 573254 | 10/1977 | U.S.S.R. | 164/453 |

*Primary Examiner*—Nicholas P. Godici
*Assistant Examiner*—J. Reed Batten, Jr.
*Attorney, Agent, or Firm*—Jordan and Hamburg

[57] ABSTRACT

A horizontal continuous casting method for continuously feeding a molten metal stored in a tundish through a tundish nozzle located in the vicinity of the tundish at its bottom to a mold horizontally connected to the tundish nozzle to produce a strand, wherein an electromagnetic field generating device is arranged in the vicinity of the boundary between the tundish nozzle and the mold for exerting an electromagnetic force directed toward a center of the molten metal flowing through the vicinity of the boundary or in a strand withdrawing direction, to separate the molten metal from the inner surface of the tundish mozzle anterior to the boundary with respect to the strand withdrawing direction, to allow the molten metal to come into contact with the inner surface of the mold posterior to the boundary with respect to the strand withdrawing direction. Control of the electromagnetic force exerted on the molten metal is effected by the electromagnetic field generating device arranged in the vicinity of the boundary in such a manner that a point at which the molten metal begins to come into contact with the inner surface of the mold coincides with a predetermined point. The electromagnetic force may also be controlled in such a manner that the points at which the molten metal begins to come into contact with the inner surface of the mold are brought to the same position peripherally of the molten metal with respect to the axis thereof.

11 Claims, 35 Drawing Figures

HORIZONTAL CONTINUOUS CASTING METHOD

This invention relates to a horizontal continuous casting method of continuously feeding a body of molten metal stored in a tundish through a tundish nozzle to a mold connected horizontally to the tundish in the vicinity of its bottom to thereby cast a body of molten metal in the mold and continuously withdrawing from the mold a strand formed therein. More particularly, it is concerned with a horizontal continuous casting method wherein electromagnetic field generating means are provided in the vicinity of the boundary between the tundish nozzle and the mold for exerting on the molten metal flowing near the boundary an electromagnetic force oriented toward the center of the molten metal flowing through the mold or in the strand withdrawing direction, and the molten metal is released from the inner surface of the tundish nozzle before reaching the boundary and brought into contact with the inner surface of the mold after flowing through the boundary.

Heretofore, a horizontal continuous casting installation of the aforesaid construction has been constructed such that the tundish nozzle formed of refractory material and the mold cooled with water are intimately connected to each other to keep the molten metal from leaking therebetween. As a result, because a portion of the tundish nozzle adjacent the water-cooled mold is cooled, a shell of solidified molten metal has tended to be formed on the outer side of the molten metal and become adhered to the tundish nozzle. Also, the molten metal has tended to invade the tundish nozzle through the pores of refractory material and become solidified therein, to thereby increase bond strength between the shell of solidified molten metal and the tundish nozzle. When this is the case, the shell of solidified molten metal undergoes rupture when the strand is withdrawn from the mold to thereby give rise to what is generally referred to as a break-out.

To obviate this problem, proposals have hitherto been made, as described in U.S. Ser. No. 388,399, to provide electromagnetic field generating means for generating a magnetic flux of higher density in the lower portion of the molten metal than in the upper portion thereof in the vicinity of the boundary between the tundish nozzle and the mold, so as to reduce the transverse dimension of the molten metal. Thus, it is possible to keep the shell of solidified molten metal from adhering to the tundish nozzle, thereby enabling continuous withdrawing to be carried out. Also, it is possible to vibrate the mold because the tundish nozzle need not be rigidly connected to the mold. This is conducive to prevention of adhesion of the shell of molten metal to the tundish nozzle or the mold.

However, when the body of molten metal stored in the tundish shows changes in its liquid level and its volume, a static pressure applied to the surface layer of the body of molten metal in the tundish or the mold may also vary. More specifically, in nonsteadystate condition in which casting is finished or ladles are changed, the molten metal shows great changes in its liquid level, and accordingly the static pressure applied to the body of molten metal in the tundish nozzle or the mold also shows great changes. In this case, the position in which the molten metal having its transverse dimension reduced by the electromagnetic field generating means begins to come into contact with the inner surface of the mold would shift depending on changes in static pressure. When the position in which contact of the molten metal with the inner surface of the mold is initiated shifts, the entire length of a cooling zone in the mold would be varied, and accordingly the shell of solidified molten metal would show changes in thickness, thereby making it impossible to obtain a sound strand. Also, the position in which the molten metal begins to separate itself from the inner surface of the tundish nozzle would shift, so that lubricant feeding ports might be obturated, making it difficult to effect application of lubricant. Further, in the mold, the static pressure of higher value is applied to a lower portion of the molten metal than to an upper portion thereof, so that a contact pressure in which the molten metal comes into contact with the inner surface of the mold would be higher in value in the lower portion of the molten metal than in the upper portion thereof. This would make the lower portion of the molten metal better cooled, to make it impossible to produce a strand of sound property due to nonuniform cooling. Still further, deformation of the strand and vertical cracks formed therein would occur due to thermal stress caused by nonuniform cooling, and the shell of solidified molten metal would undergo rupture to thereby give rise to what is referred to as a break-out. Also, the pressure at which the molten metal comes into contact with the mold increases in going toward the lower portion of the molten metal. This would cause nonsymmetrical wear to be produced such that wear increases in amount in going toward the lower portion of the inner surface of the mold. When lubricant is supplied to an interface between the molten metal and the mold, the supply of lubricant would tend to become peripherally unbalanced due to nonuniformity of contact pressure as aforesaid. This would make it impossible to uniformly lubricate the outer surface of the molten metal and the inner surface of the mold, thereby causing the shell of solidified molten metal to be ruptured.

The body of molten metal in the mold might be nonuniformly cooled not only because of nonuniformity of the aforesaid static pressure but also because of the pressure of gaps formed between the outer surface of the molten metal and the inner surface of the mold after formation of the shell of solidification. That is, as the molten metal is cooled in contact with the inner surface of the mold, the surface layer of the molten metal would be contracted and cause the shell of solidified molten metal to be formed thereon. Also, this would cause gaps to be formed between the surface layer of the molten metal and the inner surface of the mold. However, the molten metal in the mold is displaced downwardly by gravity to form larger gaps in an upper portion of the inner surface of the mold than in a lower portion of the inner surface thereof, and the molten metal having a higher contact pressure at its lower portion is brought into contact with the inner surface of the mold. As a result, the molten metal would be nonuniformly cooled due to nonuniformity of contact pressure as aforesaid.

This invention has been developed for the purpose of obviating the aforesaid problems of the prior art. Accordingly, the invention has as one of its object the provision of a horizontal continuous casting method therefor capable of keeping constant a position in which the molten metal is first brought into contact with the inner surface of the mold and a position in which the molten metal is released from contact with the inner surface of the tundish nozzle irrespective of changes in the liquid level of the molten metal in the tundish, to render peripherally uniform a thickness of a shell of solidified molten metal which occurs on the surface layer of the molten metal after being cooled at the inner surface of the mold.

Another object is to provide a horizontal continuous casting method enabling the contact pressure of the outer surface of the molten metal applied to the inner surface of the mold to be rendered peripherally uniform irrespective of nonuniform distribution of the static pressure applied to upper and lower portions of the molten metal in the mold, to solve the aforesaid problems.

The aforesaid first object can be accomplished by providing electromagnetic field generating means for controlling an electromagnetic force exerted on the molten metal in such a manner that a point at which the molten metal begins to come into contact with the inner surface of the mold is brought into coincidence with a predetermined point. Details of the method of controlling the electromagnetic force exerted by the electromagnetic field generating means will be described in detail by referring to embodiments of the invention subsequently to be described.

The aforesaid second object of the invention can be accomplished by exerting an electromagnetic force on the molten metal flowing through the mold in such a manner that distribution of the electromagnetic force corresponds to that of the static pressure acting on the surface layer of the molten metal, to thereby enable nonuniform distribution of the static pressure between upper and lower portions of the mold to be compensated for and make it possible to obtain uniform contact pressure at which the molten metal comes into contact with the inner surface of the mold along the entire periphery.

Figures 25A, 25B:
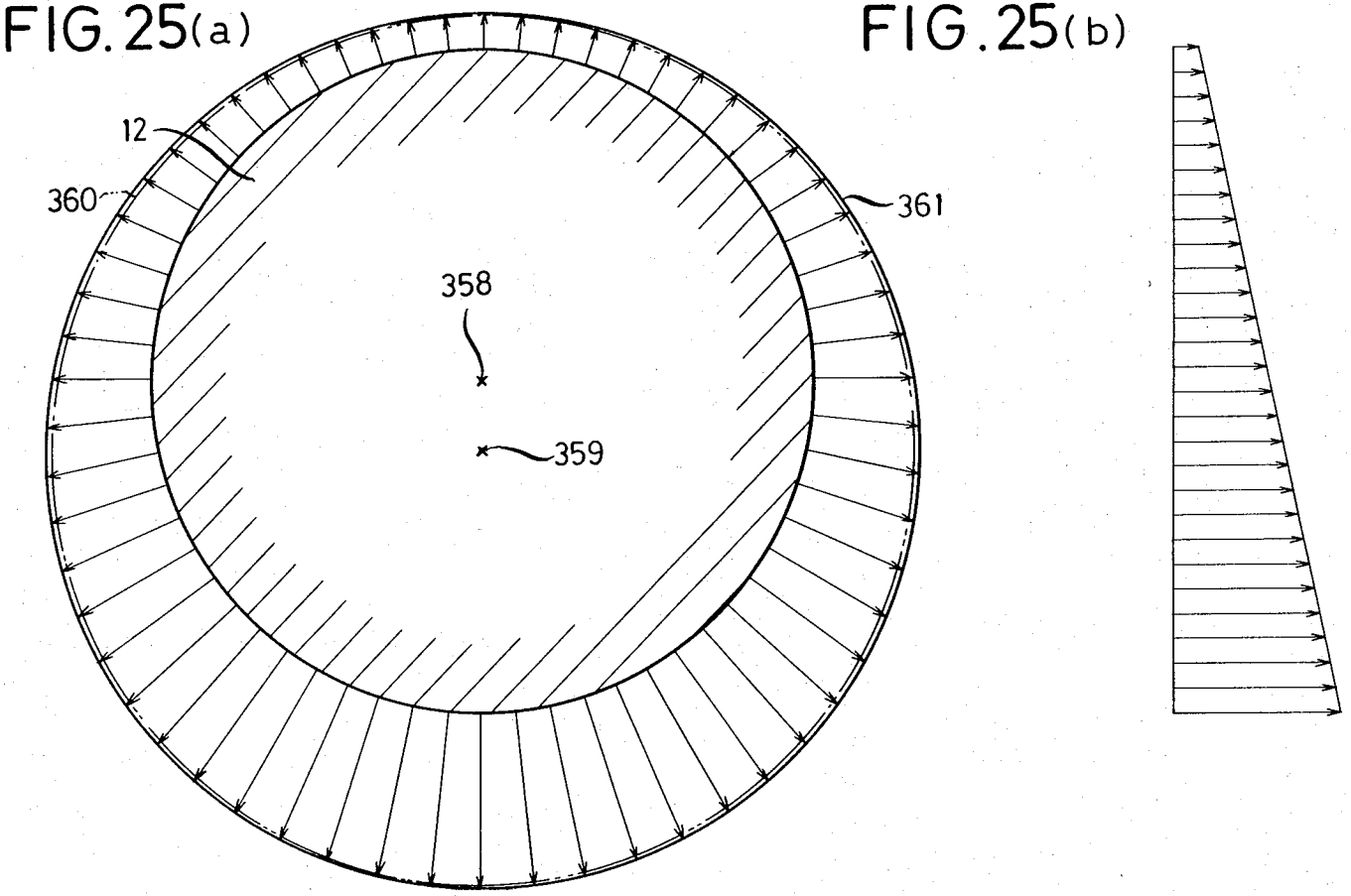
Figure 26:
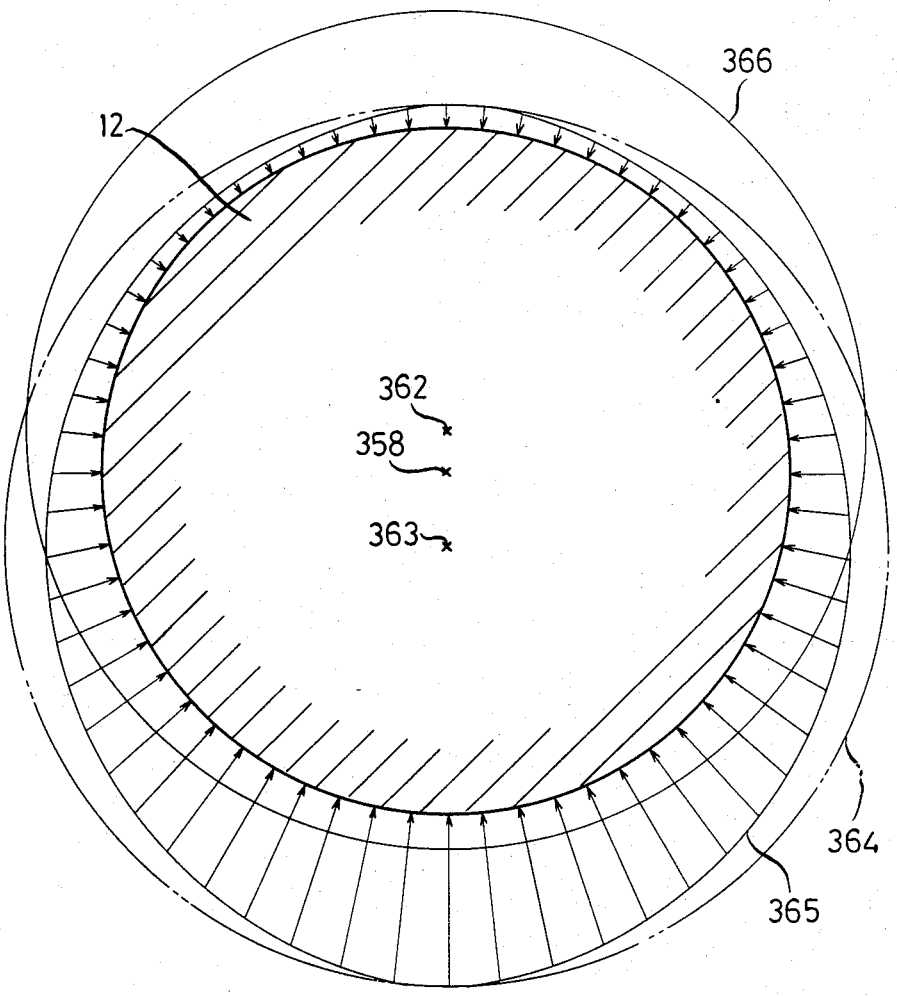
Figure 27:
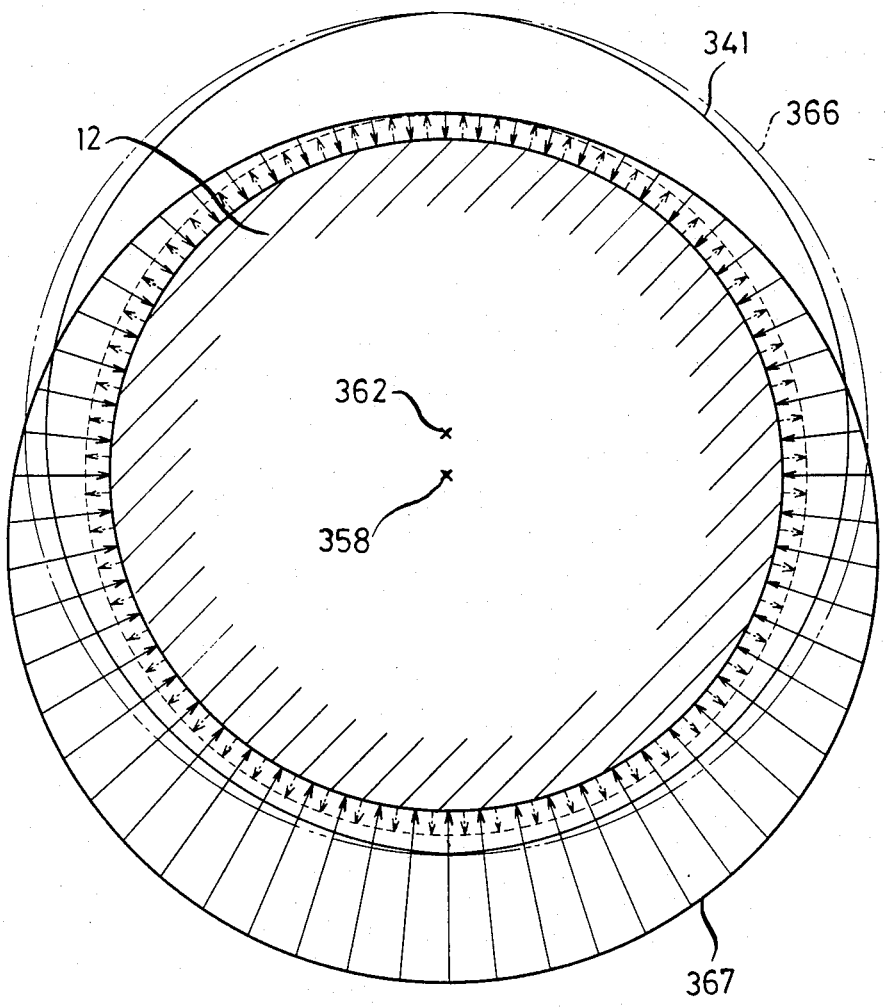
Figure 28B:
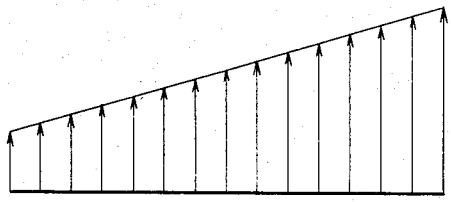
Figure 28A:
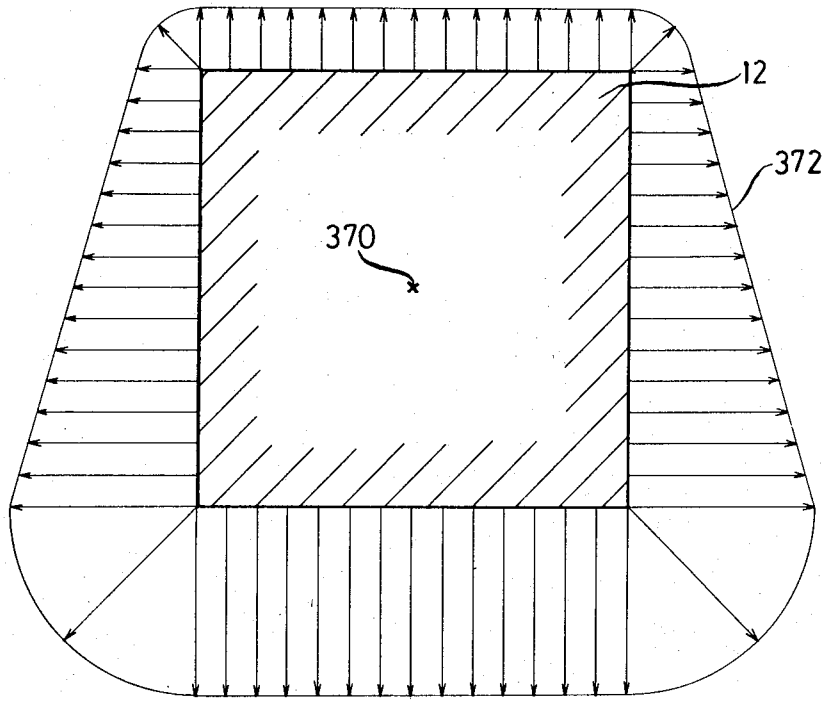
Figure 29:
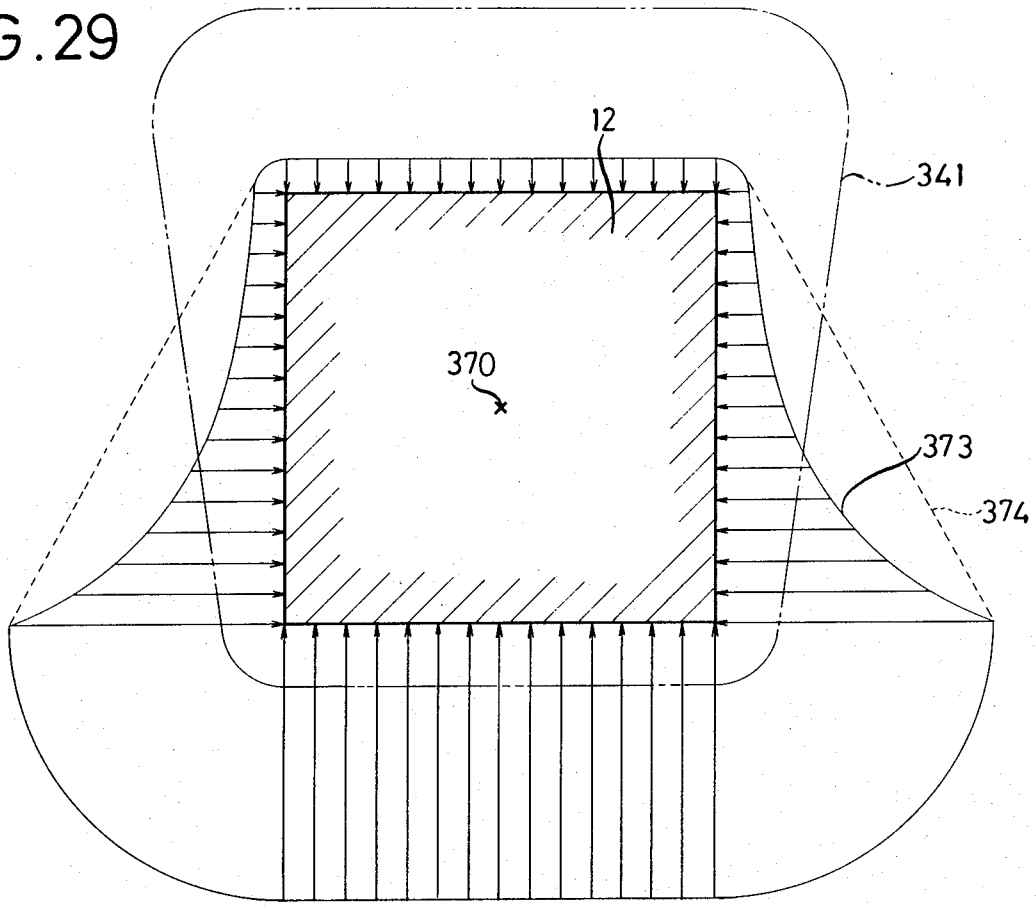
Figure 30:
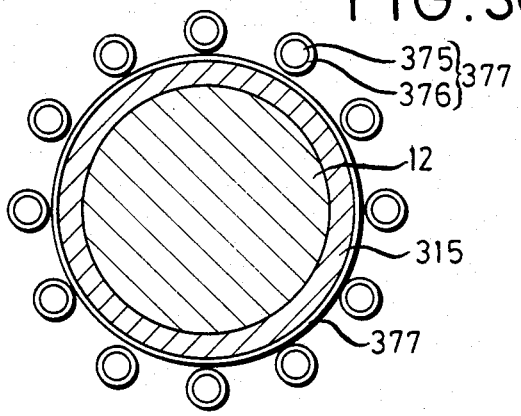
Figure 31:
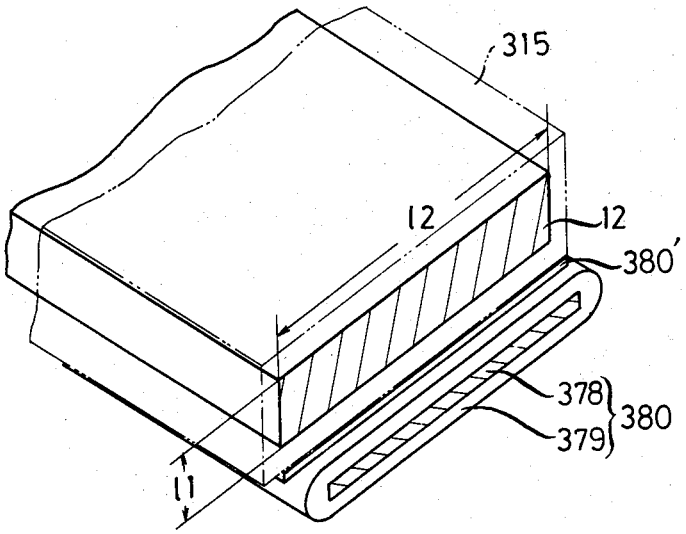
Figure 32:
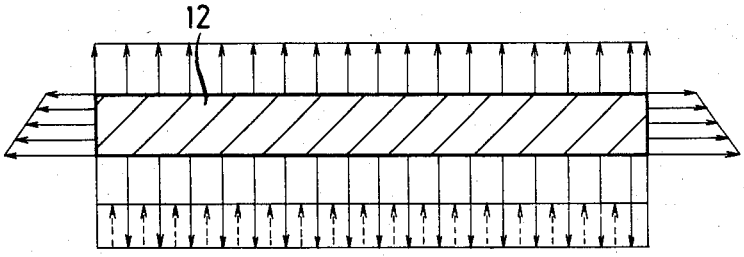
Figure 33:
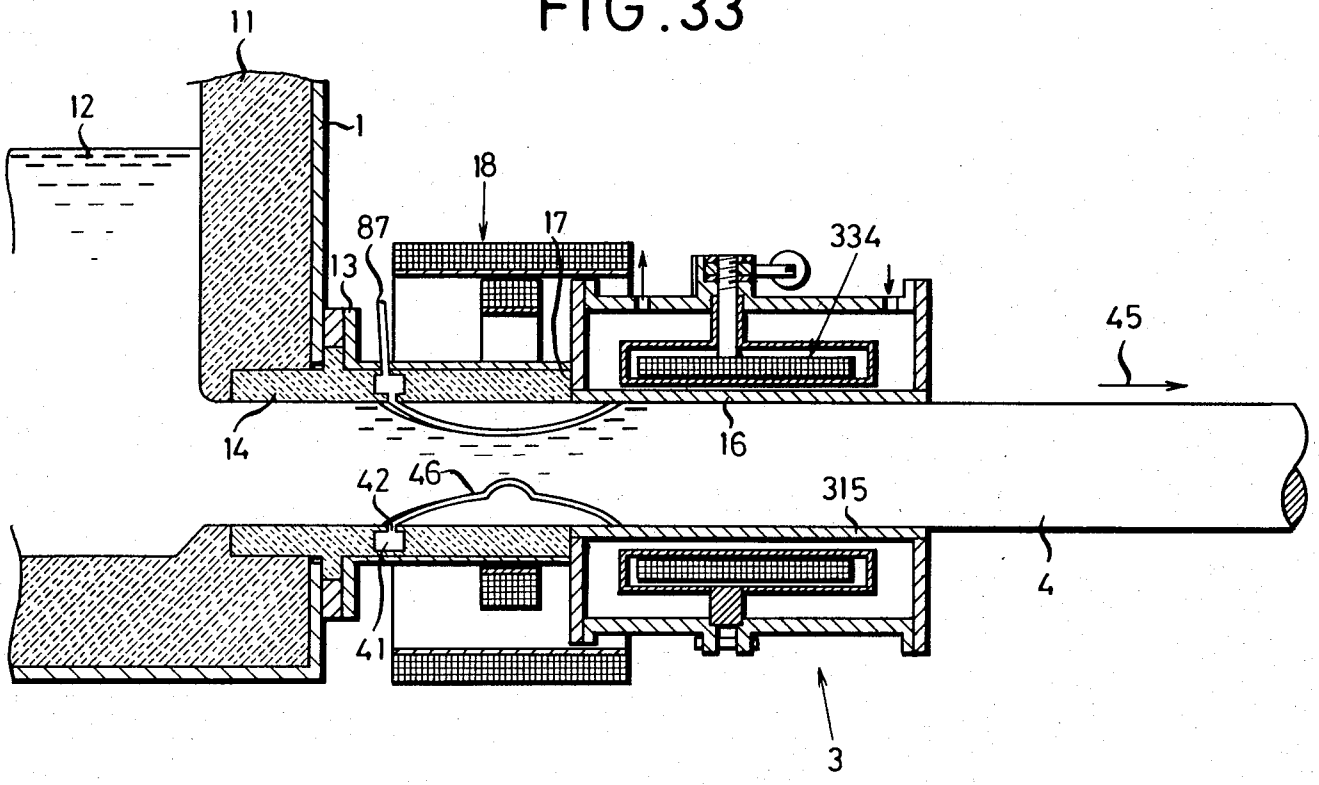

FIGS. 25(*a*) and 25(*b*) are diagrams showing the distribution of static pressures applied to the surface layer of the molten metal in the mold of circular cross section;

FIG. 26 is a diagram showing the distribution of an electromagnetic force exerted by the coils of circular cross section;

FIG. 27 is a diagram showing the distribution of an electromagnetic force exerted by the coils having their shapes modified;

FIGS. 28(*a*) and 28(*b*) are diagrams showing the distribution of static pressures applied to the surface layer of the molten metal in the mold of square cross section;

FIG. 29 is a diagram showing the distribution of electromagnetic forces exerted by coils symmetrical with the aforesaid static pressure distribution, and the distribution of electromagnetic forces exerted by the coils of the modified form;

FIG. 30 is a fragmentary sectional view of still another embodiment, showing portions of a mold;

FIG. 31 is a perspective view of still another embodiment, showing its mold portions;

FIG. 32 is a diagram showing the distribution of the static pressures and the distribution of the electromagnetic forces in the embodiment shown in FIG. 31; and FIG. 33 is a vertical sectional view of a horizontal continuous casting installation comprising still further embodiment.

Figure 1:
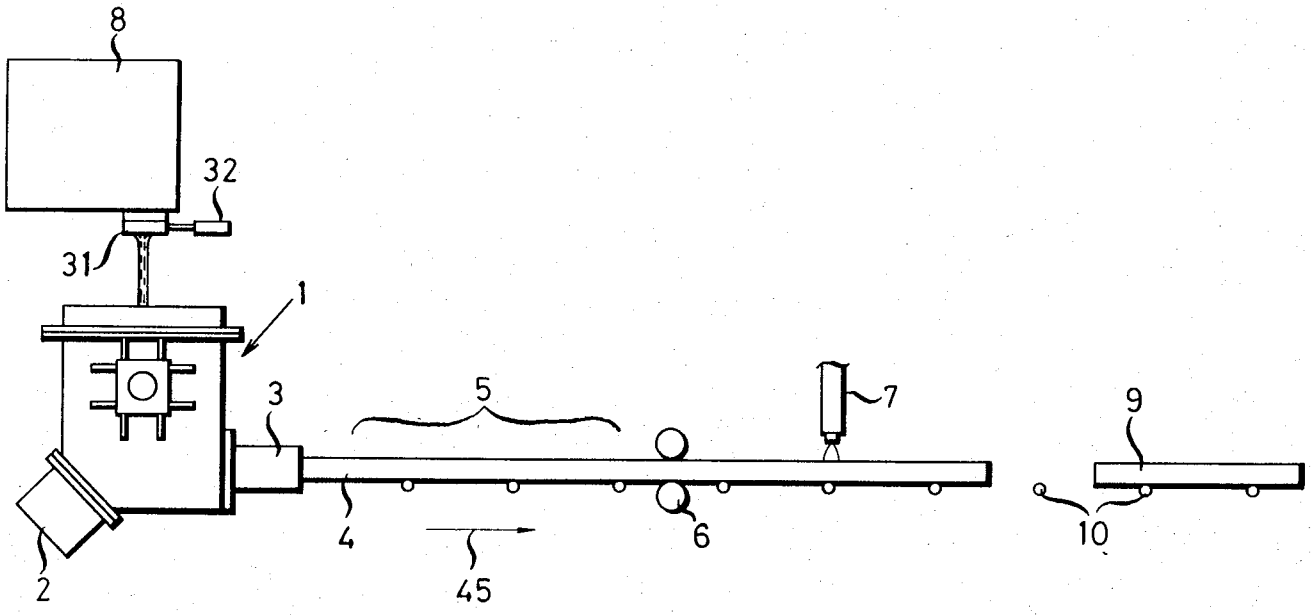
FIG. 1 PRIOR ART
FIG. 1 is a side view of one example of horizontal continuous casting installations of the prior art, showing the construction of the installation in its entirety.

FIG. 1 shows one example of horizontal continuous casting installations of the prior art for producing a strand, showing the construction of the installation in its entirety. As shown in the figure, the installation comprises a tundish 1 equipped with a heating device 2 for stabilizing the temperature of a molten steel fed through a ladle 8 into the tundish 1. A strand 4 cast in a mold 3 and released therefrom is withdrawn from a cooling zone 5 by a withdrawing device 6 in a horizontal direction indicated by an arrow 45 and cut by a cutting device 7 to provide an ingot 9. The ingot 9 is transferred by a roller table 10.

Figure 2:
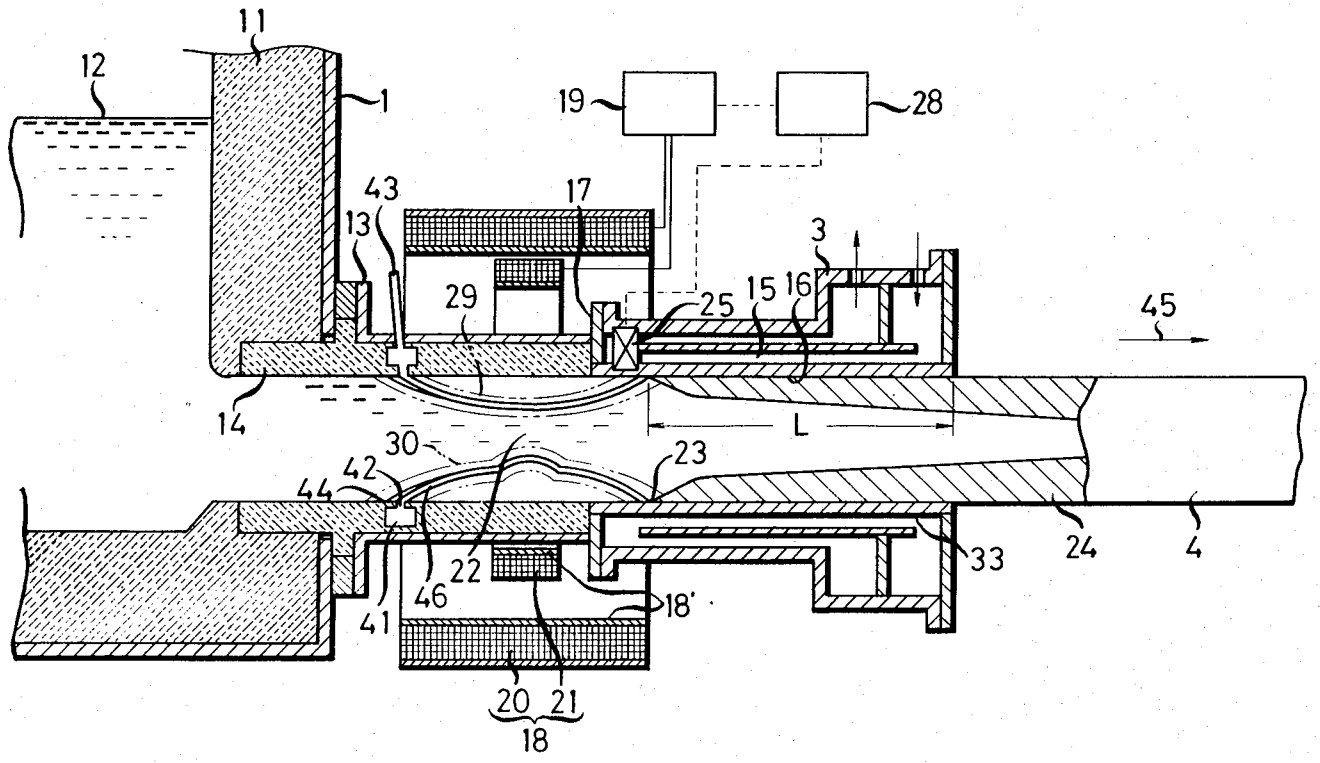
FIG. 2 is a sectional view of the horizontal continuous casting installation comprising one embodiment of the invention, showing portions of the installation in the vicinity of the tundish nozzle and the mold.

FIG. 2 is a sectional view of an embodiment of the invention incorporated in the installation shown in FIG. 1, showing, on an enlarged scale, portions of the installation in the vicinity of the tundish nozzle and the mold.

The tundish 1 has a lining of refractory material 11 and stores a body of molten steel 12.

The tundish 1 has secured thereto a tundish nozzle 14 formed of refractory material attached thereto by a mounting member 13. The mold 3 has a cooling liquid passage 15 for achieving water cooling of a mold tube 33 formed of copper and a strand passage 16 connected coaxially to the tundish nozzle 14 to allow the strand 4 to move therethrough. The mold 3 is rigidly secured to the tundish nozzle 14. Electromagnetic field generating means 18 is located in the vicinity of a boundary 17 between the tundish nozzle 14 and the mold 3 and comprises a first coil 20 and a second coil 21 enclosing the vicinity of the boundary 17 and energized by an AC power fed from a power source 19. The molten metal flowing through the vicinity of the boundary has its transverse dimension reduced radially inwardly by an electromagnetic field generated by the electromagnetic field generating means 18. Thus, it is possible to prevent the molten steel 12 from being brought into contact with a portion of the tundish 14 close to the mold 3 in the vicinity of the boundary, thereby keeping a shell of solidified molten metal from adhering to the tundish nozzle 14 and enabling the strand 4 to be continuously withdrawn from the mold 3.

The two coils 20 and 21 composing the electromagnetic field generating means each comprise a wire wound in such a manner that its convolutions enclose the tundish nozzle 14 and portions of the mold 3 in radially spaced apart relation to one another. When an energizing current is passed to each of coils 20 and 21, an electromagnetic force oriented toward the center of the molten steel acts thereon, to thereby have the molten steel 12 reduced in its transverse dimension in the vicinity of the boundary 17. The first coil 20 is placed in a manner to be substantially concentric with the tundish nozzle 14, while the second coil 21 is displaced in a manner to have its center axis located upwardly of the axis of the tundish nozzle 14. Thus, the first coil 20 exerts a substantial uniform electromagnetic force oriented toward the center of the molten steel on the molten steel 12 along the entire periphery of the tundish nozzle 14. The second coil 21 exerts on the molten steel 12 an electromagnetic force oriented toward the center of the molten steel and increasing in value in going toward the lower portion of the molten steel. In the tundish nozzle 14, a static pressure acts on the surface of the molten steel which increases in going toward the lower portion of the molten steel on account of its head. Thus, by suitably setting a static pressure distribution in the molten steel by causing an electromagnetic force to act thereon in a manner to have its value increase in going toward the lower portion of the molten steel, the molten steel can have its transverse dimension reduced in such a manner that the gaps between the molten steel 12 and the inner surface of the tundish nozzle 14 become substantially uniform in the peripheral direction. Moreover, a cross section of a reduced diameter portion 19 of the molten steel perpendicular to the withdrawing direction 45 is similar in shape to and concentric with the cross section of a mold tube 33. When the energizing current decreases in value, an induction current flows in the molten steel 12 in a direction opposite the direction in which it flows when the energizing current increases in value, thereby causing a negative converging force to be exerted on the molten steel 12. To cope with this situation, induction current absorbing plates 18' are mounted radially inwardly of the first and the second coil 20 and 21 to absorb the inverse induction current.

The tundish nozzle 14 is formed with an annular lubricant header 41 and a nozzle 42 directed radially toward the inner surface of the tundish nozzle 14. A lubricant 46 is supplied under pressure to the header 41 through a conduit 43. The nozzle 42 is located downstream of a point where the molten metal 12 begins to separate itself from the tundish nozzle 14, with respect to the direction 45 in which the strand is withdrawn. The lubricant 46 contains as its main constituents CaO, $SiO_2$ and $Al_2O_3$ in powder form or rape seed oil added with pure iron and cobalt in powder form of high electric conductivity. When the lubricant contains the aforesaid powder of high electric conductivity, the electromagnetic force directed radially inwardly of the tundish nozzle 14 and the mold 3 acts on such powder of high electric conductivity, to allow the lubricant 46 to be positively deposited on the entire outer peripheral surface of the molten metal 12 that has had its dimension reduced transversely, thereby improving the lubricating function of the portion of the molten metal 12 which is first brought into contact with a strand passage 16.

In the horizontal continuous casting installation described hereinabove, when the body of molten metal in the tundish 1 shows changes in its volume and its liquid level, the static pressure applied to the surface layer of the molten metal in the vicinity of the boundary 17 would show changes in value, to cause a point 23 at which a reduced diameter portion 22 of the molten metal 12 begins to come into contact with the inner surface of the mold tube 33 in the mold to be displaced. As a result, a distance L between the point 23 at which the molten metal begins to come into contact with the inner surface of the mold tube 32 and a point at which the strand is withdrawn from the surface of the mold would be varied. The thickness of a shell of solidified molten metal formed on the surface layer of the molten metal 12 would vary and a point where the molten metal begins to separate itself from the tundish nozzle 14 would also be displaced. This would cause stable application of lubricant to be interrupted, making it impossible to obtain a sound strand 4.

Figure 3:
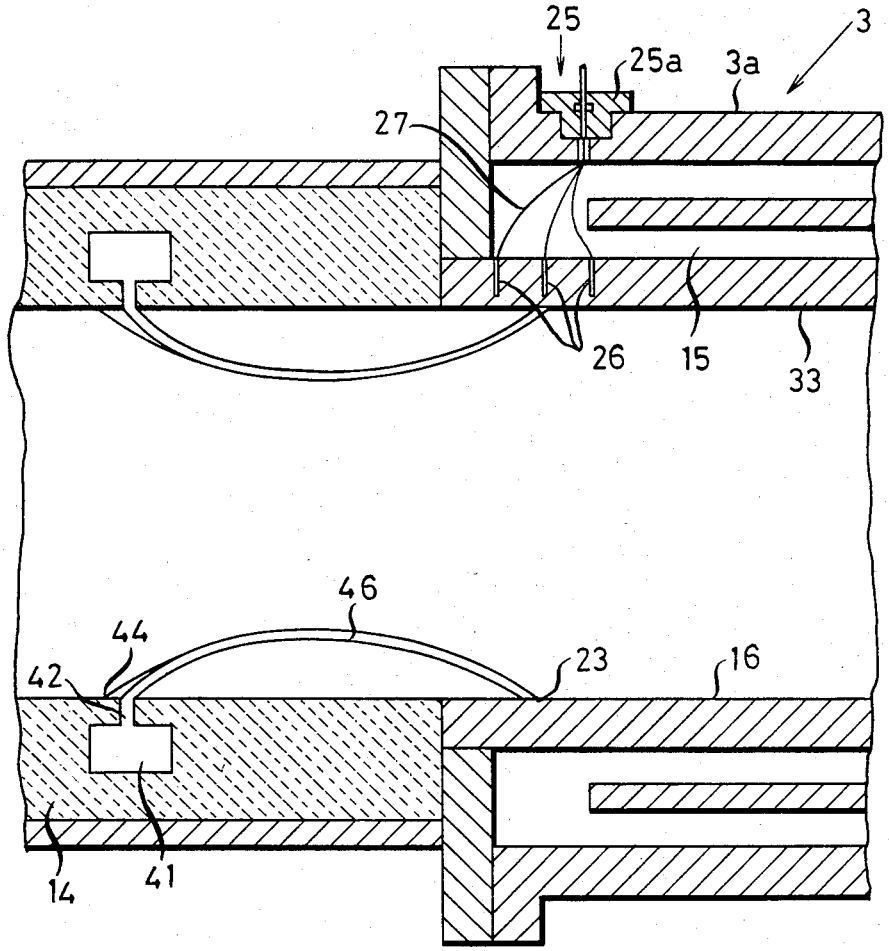
FIG. 3 is a sectional view, on an enlarged scale, of portions of the installation in the vicinity of position sensing means.

To obviate the aforesaid problem, an electromagnetic force generated by the electromagnetic field generating means is adjusted in value in a manner to have the contact initiating point 23 constantly kept at a point at which the molten steel begins to come into contact with the surface of the mold. To effect adjustments of the electromagnetic force as aforesaid, the embodiment of the invention comprises position sensing means 25 located in the vicinity of the predetermined contact initiating point 23. The position sensing means are arranged such that a plurality of thermocouples 26 are embedded in the mold tube 33 and placed axially thereof in spaced-apart relation to one another, as indicated in detail in FIG. 3. Compensation conductors 27 for the thermocouples 26 are watertightly led out of the mold through a plug **25*a* securedly fitted to an outer wall 3*a* of the mold 3. The contact point at which the molten metal 12 begins to come into contact with the inner surface of the mold tube 33 shows an increase in temperature, so that the point at which one thermocouple has sensed the highest temperature of all thermocouples 26 is regarded as the contact initiating point 23. However, the contact initiating point sensing means 25 is not limited to the aforesaid thermocouples 26 and a temperature sensitive magnetic member or $\gamma$ rays may be used as the point sensing means 25**. When the field intensity is so high that it exerts influence on contact point sensing, supply of power to the electromagnetic force generating coils had better be stopped for a very short time when a current value reaches a point of O, to enable sensing of the contact point to be effected.

The actual contact initiating point at which the molten metal actually begins to come into contact with the inner surface of the mold tube 33 is sensed by the point sensing means 25 and then applied in signal form to a control means 28. Thus, power supply from the power source 19 to the second coil 21 can be adjusted to control the electromagnetic force generated by the electromagnetic field generating means 18 in such a manner to bring a contact initiating point at which the molten metal begins to come into contact with the mold tube into agreement with the contact initiating set point 23. When the body of molten metal 12 in the tundish 1 increases in volume to allow its liquid level to move upwardly and a static pressure applied to the molten metal 12 in the vicinity of the boundary 17 is high, the reduced diameter portion 22 shows an increase in its transverse dimension as indicated by imaginary lines 29. In accordance with the aforesaid changes, the point at which the molten metal begins to come into contact with the inner surface of the mold tube 33 is displaced upstream of the contact initiating set point 23 with respect to the direction in which the molten metal is withdrawn. Then, the control means 28 increases the power supplied from the power source 19 and also the electromagnetic force exerted by the second coil 21. By virtue of this feature, the increased static pressure can be compensated for by the increased electromagnetic force, to allow the reduced diameter portion 22 to be restored to the position indicated by solid lines shown in FIG. 2, thereby enabling a contact point at which the molten metal begins to come into contact with the inner surface of the mold tube 33 to be brought into agreement with the set point 23. Conversely, when the molten metal 12 in the tundish 1 shows a decrease in volume to lower the liquid level thereof and the static pressure applied to the molten metal in the vicinity of the boundary 17 is reduced in value, the portion 22 is reduced in its transverse dimension as indicated by the imaginary lines 30 shown in FIG. 2, to thereby cause the contact point to be displaced downstream of the contact initiating set point 23 with respect to the withdrawing direction 45. Then, the control means 28 decreases the power supplied from the power source 19 and also the electromagnetic force exerted by the second coil 21. By virtue of this feature, the reduced diameter portion 22 is restored to the original position to thereby enable the contact initiating point to be brought into coincidence with the set point 23.

From the foregoing description, it will be seen that the contact initiating point at which the molten metal 12 begins to come into contact with the inner surface of the mold tube 33 is kept at the predetermined set point 23, to allow the thickness of the shell 24 of solidified molten metal to be kept constant, thereby making it possible to obtain a sound strand.

Furthermore, since the diameter of the reduced diameter portion 22 is substantially constant, a point 44 at which the molten metal 12 begins to separate itself from the inner surface of the tundish nozzle 14 is kept substantially constant. Thus, the nozzles 42 for use in applying the lubricant 46 are not obturated by the molten metal 12, thereby enabling stable application of the lubricant to be effected.

By eccentrically arranging the second coil 21 and the tundish nozzle 14 as aforesaid, it is possible to bring the points at which the molten metal 12 begins to come into contact with the inner surface of the mold tube 33 into coincidence with the contact initiating set point along the entire circumference with respect to the axis of the tundish nozzle 14. However, when the body of the molten metal in the tundish shows changes in its volume, the contact initiating points may vary between the upper and lower portions of the inner surface of the mold tube 33. In this case, the thickness of the shell of solidified molten metal is not kept constant along the entire periphery of the molten metal, so that it is necessary to bring the contact points at which the molten metal begins to come into contact with the inner surface of the mold tube 33 into agreement with each other in the upper and lower portions of the mold tube. To this end, one only has to sense the contact initiating points of the molten metal on the upper and lower inner surfaces of the mold tube 33 and move the second coil 21 in a vertical direction to adjust the electromagnetic force applied from the coil to the molten metal in such a manner that the cross-sectional shape of the reduced diameter portion 22 becomes similar to that of the mold tube 33 to obtain uniform distribution of the points at which the molten metal 12 begins to come into contact with the inner surface of the mold tube 33 along the entire periphery with respect to the axis of the mold. In this case, by adjusting the power supplied from the power source 19 to the second coil 21, it is possible not only to bring the contact initiating points at which the molten metal begins to come into contact with the inner surface of the mold tube into agreement with each other in the upper and lower surfaces of the mold tube 33 but also to keep such points at the set point 23.

One embodiment in which the second coil 21 is moved in a vertical direction to attain the aforesaid end, will be described by referring to FIGS. 4, 5 and 6. In the embodiment, the second coil 21 is shifted upwardly and downwardly by drive means 31. As shown in FIG. 7, the distance covered by movement of the second coil 21 is controlled by control means 32 in such a manner that the contact points at which the molten metal 12 begins to come into contact with the inner surface of the mold tube 33 are sensed by the contact point sensing means 34 and 35 located in the upper and lower portions respectively of the mold tube 33 in the vicinity of the predetermined contact initiating point 23 and are located substantially at the same point with respect to the axis of the mold tube 33.

Fixedly located downwardly of the boundary 17 between the tundish nozzle 14 and the mold 3 is a pedestal 36 which has secured thereto posts 37 and 38 located in an upright position on opposite sides of the tundish nozzle 14, and supporting parts 39 and 40 respectively at their upper end portions. The first coil 20 is contained in a first box 47 of rectangular cross section perpendicular to the axis of the tundish nozzle 14 and the mold 3, such first box 47 being securedly mounted in a first cooling box 48. Inert gas sealed in the first box or an insulating cooling fluid flows in circulation therethrough. Cooling water flows through the cooling box 48. The first box 47 and the first cooling box 48 are secured to a first support frame 49 in a unitary structure. Projections 50 and 51 extend outwardly from opposite sides of the first support frame 49 in positions above the support 39 and 40. Bolts 52 and 53 threadably engage the projections 50 and 51 and extend downwardly into abutting engagement with the the surface of the supports 39 and 40 respectively. Bolts 54 and 55 threadably engage the supports 39 and 40 and extend into abutting engagement with the sides of the projections 50 and 51 respectively. Thus, by adjusting the distance covered by the extensions of the bolts 52, 53, 54 and 55, it is possible to adjust as desired the vertical and horizontal portions of the first support frame 49 or the first coil 20.

The second coil 21 is contained in a second box 56 located between the tundish nozzle 14 and the first coil 20. The second box 56 is of rectangular form in a cross section perpendicular to the axis, and encloses the tundish nozzle 14, with inert gas being sealed therein or an insulating cooling fluid circulating therethrough. The second box 56 is fixedly mounted in a second cooling box 57 having cooling fluid flowing therethrough. The second box 56 and the second cooling box 57 are fixed to the second support frame 58 as a unit. The first support frame has secured thereto at its opposite sides guide members 59 and 60 extending inwardly at its opposite ends in the withdrawing direction 45, and the second support frame 58 has secured thereto at its opposite sides slide members 61 and 62 slidably arranged in sliding engagement with guide members 59 and 60 respectively. The guide members 59 and 60 and slide members 61 and 62 guide the second support frame 58 and the second coil 21 in a vertical direction.

The drive means 31 comprises first bell cranks 63 and 64, a connecting bar 65, a second bell crank 66, a hydraulic cylinder 67 and hydraulic fluid supply means 68. The first bell cranks 63 and 64 support at one end thereof rollers 69 and 70 respectively for rotation about an axis parallel to the withdrawing direction 45, such rollers 69 and 70 abutting against the underside of the second support frame 58. The bell cranks 63 and 64 have bends supported by shafts 71 and 72 located parallel to the axes of rotation of rollers 69 and 70 on legs 73 and 74, respectively, on the pedestal 36.

The connecting bar 65 extends in the withdrawing direction 45 below the first support frame 49, and is connected at its one end portion and intermediate portion thereof to the other end portions of the first bell cranks 63 and 64 through shafts 75 and 76 extending parallel to the shafts 71 and 72 respectively. The second bell crank 66 has a bend pivotably supported by a pin 77 parallel to the shafts 71 and 72 and secured to the post 38, one end portion connected to the other end portion of the connecting bar 65 through a pin 78, and the other and portion connected through a pin 80 parallel to the pin 78 to a forward end portion of a piston rod 79 of the hydraulic cylinder 67 supported on the support 38 and having a vertically extending axis.

In the drive means of the aforesaid construction, when the hydraulic cylinder 67 is actuated, the second bell crank 66 swings about the pin 77 in directions shown by an arrow 81, and accordingly the connecting bar 65 is moved axially in reciprocatory movement as indicated by an arrow 82, to allow the first bell cranks 63 and 64 to swing about the shafts 71 and 72 respectively in directions indicated by an arrow 83. Thus, the second support frame 58 and the second coil 21 are moved upwardly and downwardly by the rollers 69 and 70. The springs 84 are mounted between the surface of an upper portion of the second support frame 58 and the underside of an upper portion of the first cooling box 48, so that the second support frame 58 is urged downwardly by the biasing forces of the springs 84.

As shown in FIG. 7, the position sensing means 34 and 35 are arranged for sensing the points at which the molten metal begins to come into contact with the inner surface of the mold tube 33 in its upper and lower portions at its end portion near the tundish nozzle 14. Like the position sensing means 25 shown in FIGS. 1-3, for example, the position sensing means 34 and 35 comprise a plurality of thermocouples 85 and 86 embedded in the mold tube 33 in positions axially spaced apart from one another. The contact initiating points of the molten metal in its upper and lower portions sensed by the position sensing means 34 and 35 of this construction are supplied to the control means (FIG. 4).

Figure 8:
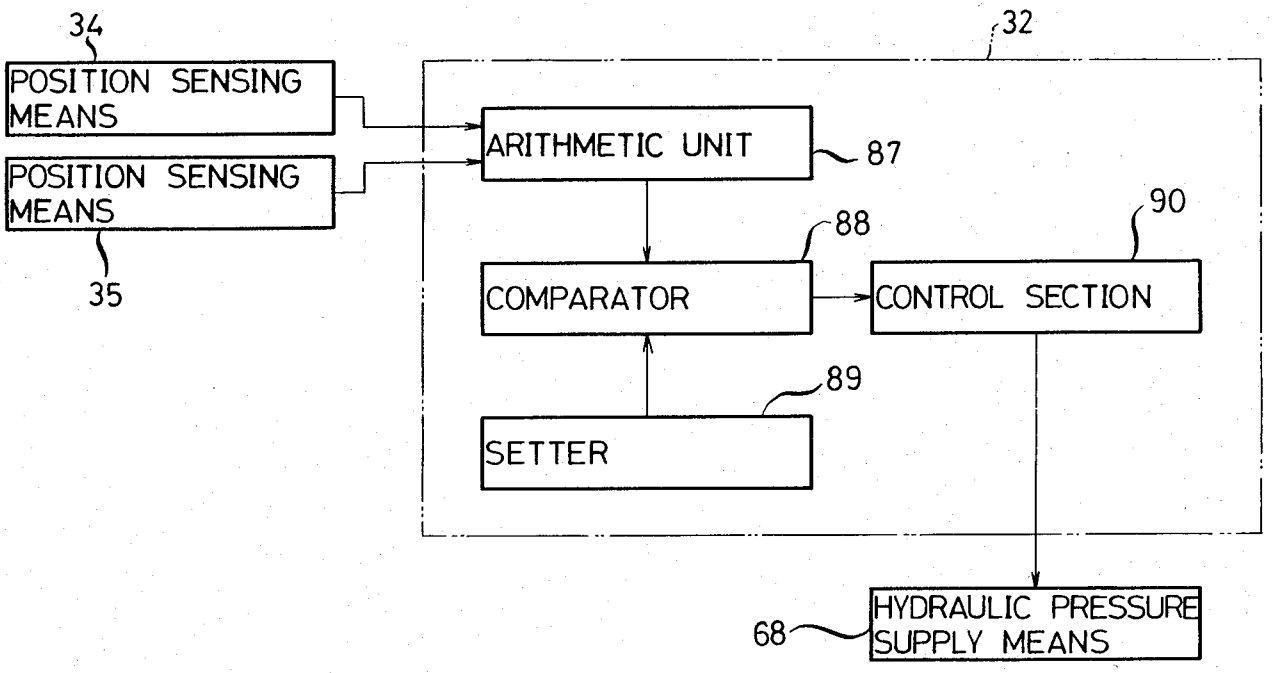
FIG. 8 is a block diagram showing the construction of control means in FIG. 4.

FIG. 8 is a block diagram showing the construction of the control means 32. The signals from the position sensing means 34 and 35 are supplied to a comparator 88 through an arithmetic unit 87 of the control means 32. The signals from a setter 89 are inputted to the comparator 88 which applies to a control section 90 a signal corresponding to the difference in voltage between two signals from the arithmetic unit 87 and the setter 89. The control section 90 controls the hydraulic pressure supply means 68 in accordance with the signal from the comparator 88. Vertical positions of the second coil 21 driven by the drive means 31 are controlled by the control means 32 in such a manner that the positions in which the molten metal 12 begins to come into contact with the inner surface of the mold tube 33 are uniform in upper and lower portions with respect to the axis of the mold tube 33. In this case, by controlling the power supplied to the second coil 21 in addition to the hydraulic pressure supply means 68 by the control section 90, it is possible to obtain uniform distribution of the points at which the molten metal begins to come into contact with the inner surface of the mold tube 33 in its upper and lower portions with respect to the axis of the mold tube 33, and also to bring such points into agreement with the set point.

When uniform distribution of the points at which the molten metal 12 begins to come into contact with the inner surface of the mold tube 33 in its upper and lower portions are obtained, opposite sides of the molten metal occupy the same point. Thus, the molten metal 12 begins to come into contact with the inner surface of the mold tube 33 at the set point along the entire inner periphery of the mold tube 33 with respect to the axial direction.

This allows the length of the cooling zone and the thickness of the shell of solidification within the mold tube 33 to become uniform along the entire outer periphery of the molten metal, making it possible to obtain a sound strand.

Figure 9:
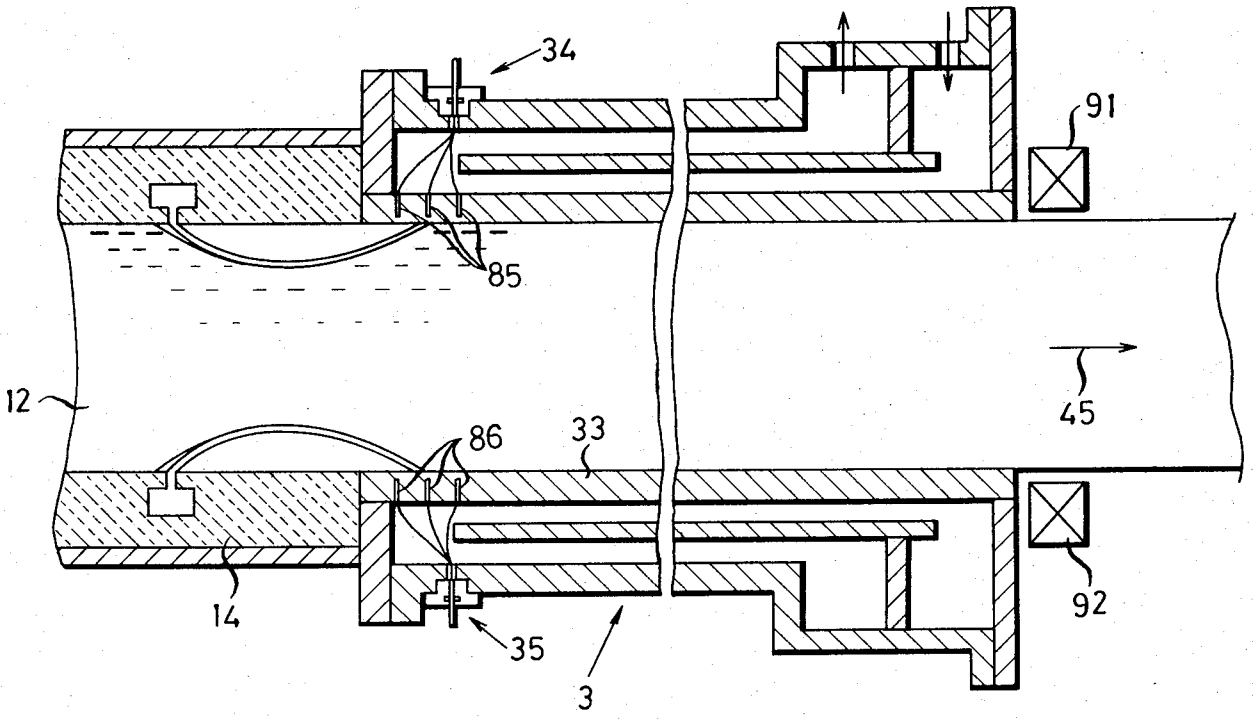
FIG. 9 is a vertical sectional view of a modification of the embodiment shown in FIG. 7.
Figure 10:
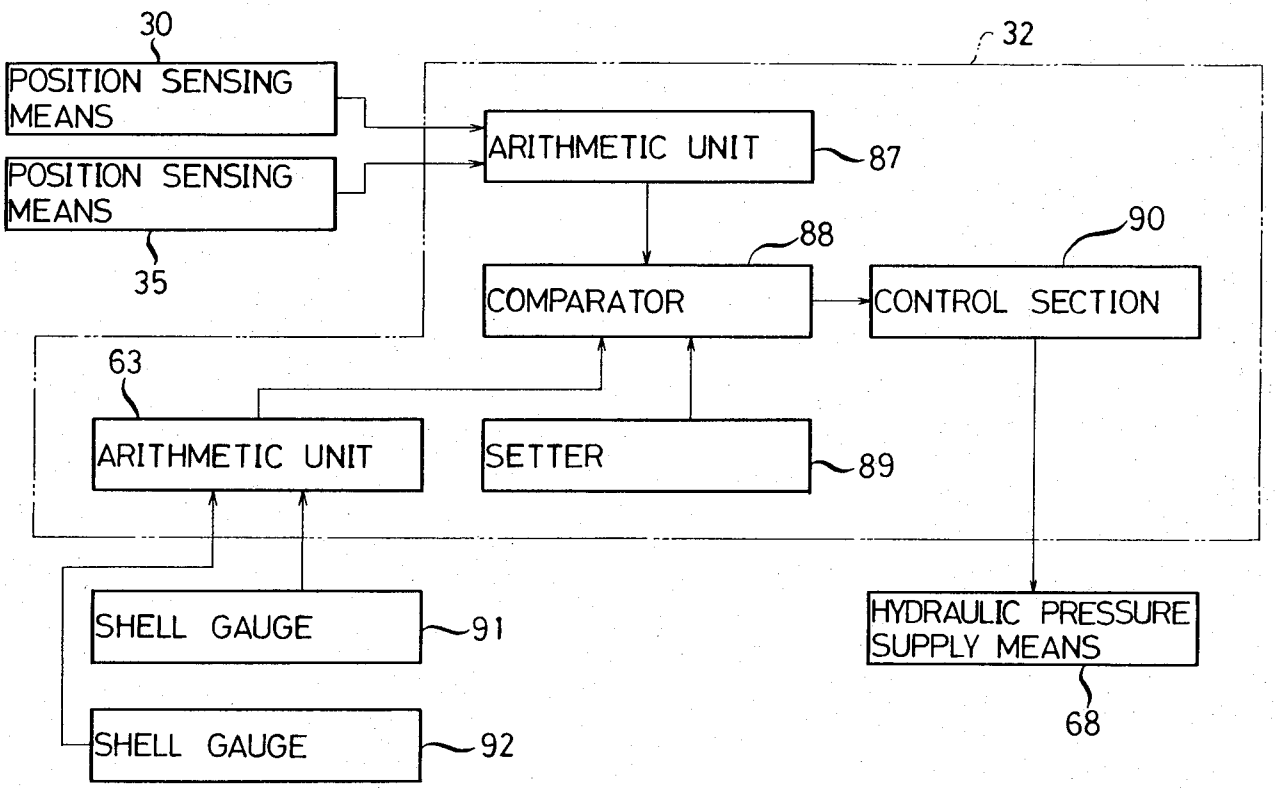
FIG. 10 is a block diagram showing the construction of the control means shown in FIG. 7.

As shown in FIG. 9, the mold 3 of the embodiment shown in FIG. 7 may be provided at its outlet with shell gauges 91 and 92 for measuring the thicknesses of the shell of solidified molten metal in the upper and lower surface layers. Measurements of the shell gauges 91 and 92 are supplied to the comparator 88 through an arithmetic unit 93 of the control means 32 shown in FIG. 10. This allows the thickness of the shell of molten metal at the outlet of the mold 3 to be supplied to the drive means 31 in feedback operation, thereby enabling control to be effected with increased accuracy. The shell gauges 91 and 92 may be replaced by radiation surface thermometers.

In the embodiments shown in FIGS. 4–18, by increasing the electromagnetic force supplied to the second coil 21, it is possible to dispense with the first coil 20.

Figure 11:
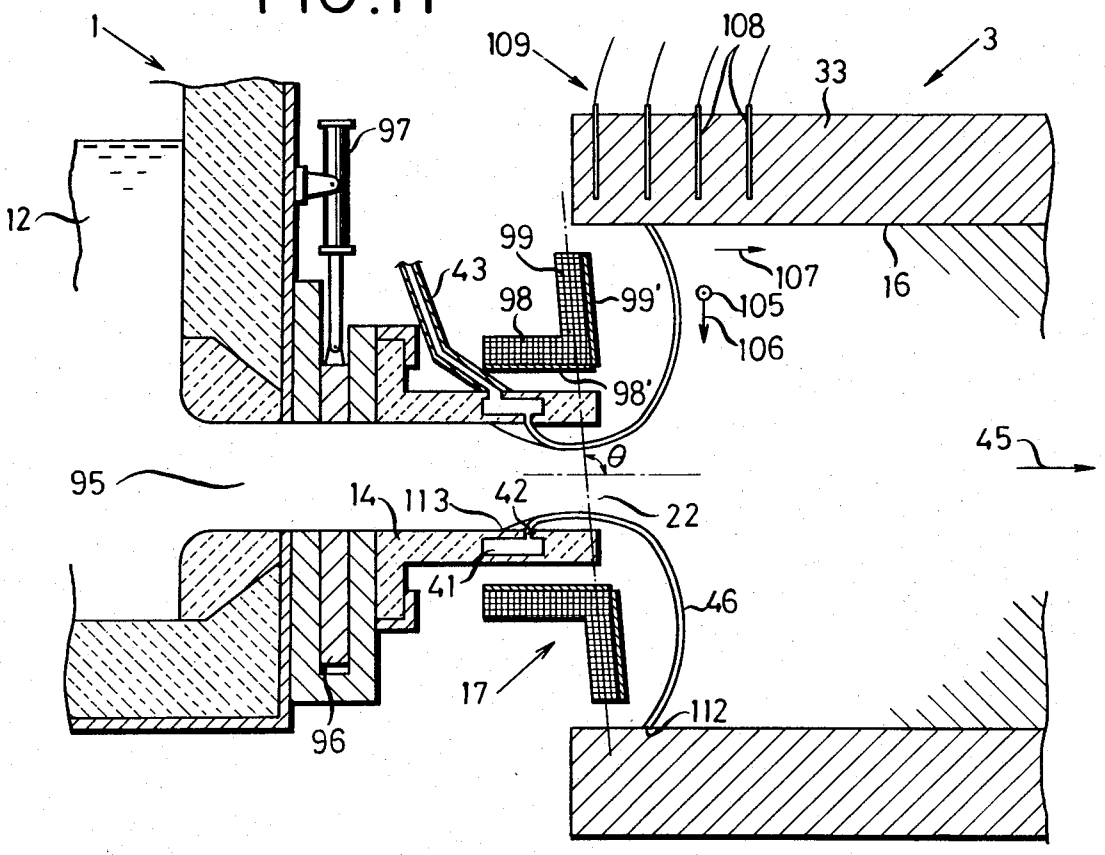
FIG. 11 is a vertical sectional view of the horizontal continuous casting installation comprising another embodiment of the invention.

FIG. 11 shows another embodiment of the invention incorporated in a continuous casting installation for casting molten metal into a strand of large cross section. The installation comprises a tundish nozzle 14 connected to a nozzle port 95 at the bottom of a tundish 1 through a sliding gate 96 opened and closed by a cylinder 96, and a mold arranged coaxially with the tundish nozzle 14 and having an inner diameter larger than the outer diameter of the tundish nozzle 14. An electromagnetic field generating means 98 located in the vicinity of the end portion of the tundish nozzle 14 close to the mold 3 is composed of a wire wound in a manner to enclose the tundish nozzle 14. Another electromagnetic field generating means 99 located in the vicinity of the end surface of the mold 3 facing the tundish nozzle 14 at the boundary 17 between the tundish nozzle 14 and the mold 3 is obliquely inclined at an angle $\theta$ with respect to the withdrawing direction 45 and arranged in a plane in which the lower portion slightly extends in the withdrawing direction 45 greater than the upper portion. Moreover, induced current absorbing plates 98' and 99' are attached to the electromagnetic field generating means 98 and 99.

The molten metal 12 flowing through the tundish nozzle 14 is radially inwardly reduced in its transverse dimension by an electromagnetic force generated by the electromagnetic field generating means 98. Meanwhile, when a current directed perpendicularly to the plane of FIG. 11 and toward its back flows to the coil of the electromagnetic field generating means 99, an eddy current designated by the numeral 105 and directed toward the plane of FIG. 11 is produced, and also a magnetic field is generated in the direction of an arrow 106. This causes an electromagnetic force indicated by an arrow 107 to be produced in the molten metal 12 which is directed in the withdrawing direction 45. Thus, the molten metal released from the inner surface of the nozzle 14 at a point 113 of the inner surface of the tundish nozzle and diverging in the radial direction is separated from the atmosphere as the electromagnetic force oriented in the direction 107 and the static pressure balances and comes into contact with the inner surface of the mold tube 33 of the mold 3 at a point 112, so that it flows in the withdrawing direction 45 and continuously cast. The tundish nozzle 14 has headers 41 for lubricant 46 mounted on its entire periphery and includes a nozzle 42 opening at the inner surface of the tundish nozzle 14 in a position anterior to the point 113 at which the molten metal begins to separate itself from the inner surface of the tundish nozzle 14. Moreover, the electromagnetic field generating means 99 is arranged such that it is obliquely inclined at an angle $\theta$ with respect to the axis of the mold 3 and it is successively tilting toward the withdrawing direction 45 in going toward the lower portion, the electromagnetic force of a higher magnitude is applied to the lower portion of the molten metal 12 of high static pressure in the mold 3 than the upper portion thereof. Thus, it is possible to keep the rear end face of the molten metal 12 in the mold 3 in a plane substantially normal to the withdrawing direction 45. Consequently, it is possible to obtain substantially uniform distribution of the points at which the molten metal 12 is brought into contact with the inner surface of the mold tube 33 along the entire circumference with respect to the axis of the molten metal. This enables uniform cooling of the molten metal to be achieved in the mold 3 without the length of the contact of the molten metal in the mold 3 being varied in the vertical direction.

The horizontal continuous casting installation of the aforesaid construction has already been proposed. However, in the embodiment shown in FIG. 11, position sensing means 109 comprising a plurality of thermocouples 108 is provided by the invention, such being similar to the position sensing means 25 shown in FIG. 3 and located in a position disposed peripherally of the mold tube 33 near the end of the mold adjacent the tundish nozzle. The power supplied to the electromagnetic field generating means 98 and 99 is controlled by control means, not shown, in a manner to allow the contact initiating point 112 of the molten metal sensed by the position sensing means 109 to be brought into agreement with a predetermined set point. By virtue of the aforesaid feature, it is possible to keep the contact initiating point substantially constant irrespective of changes in the static pressure acting on the surface layer of the molten metal 12 in the vicinity of the boundary 17, to enable a sound strand to be produced. The separation initiating point 113 is also kept constant, so that the nozzle 42 for lubricant 46 can be prevented from being obturated.

Figure 12:
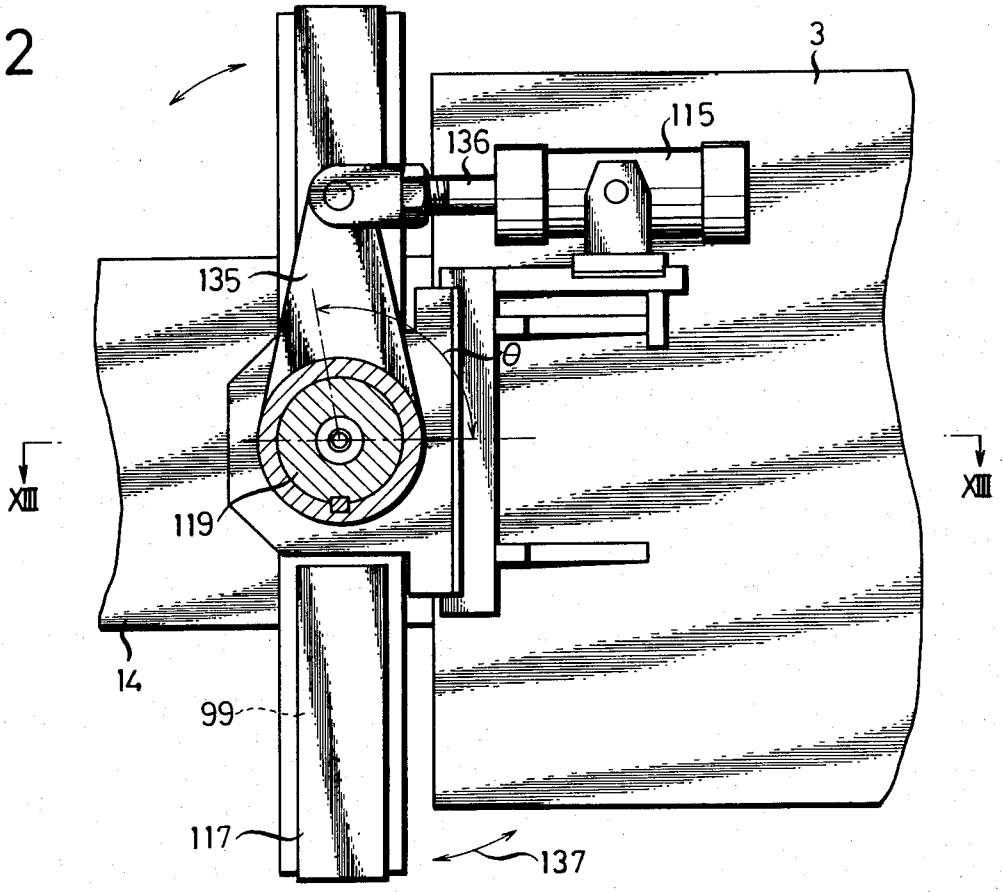
FIG. 12 is a side view of the installation comprising still another embodiment.
Figure 13:
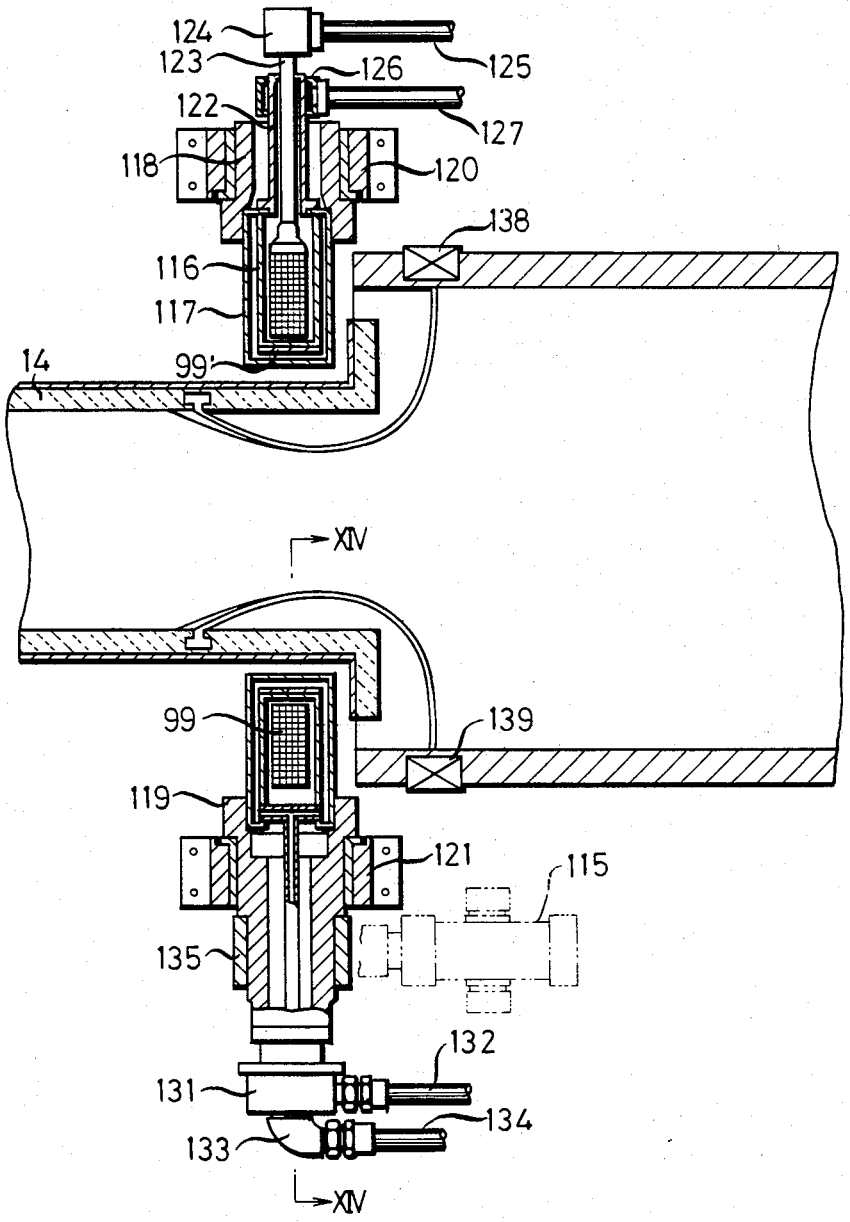
FIG. 13 is a sectional view taken along the line XIII—XIII in FIG. 12.
Figure 14:
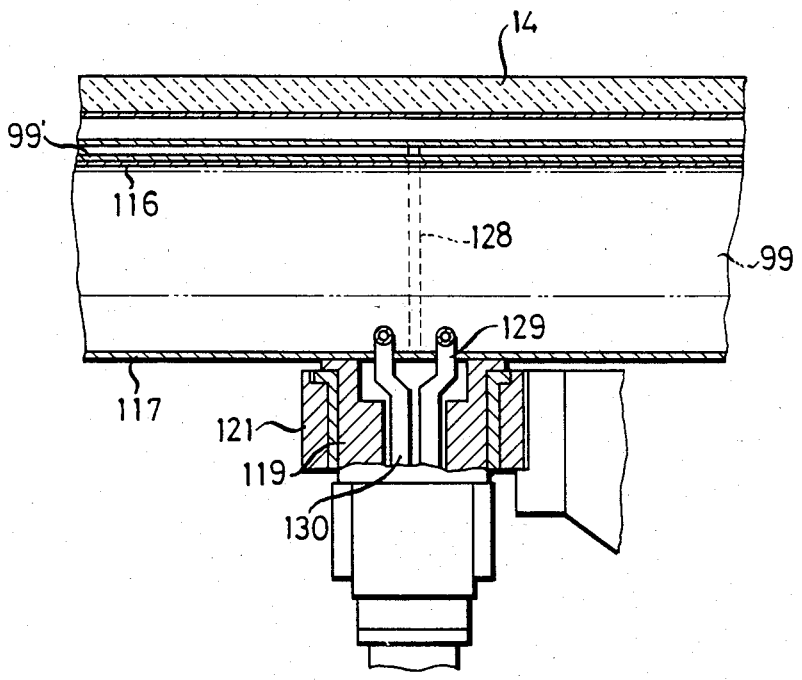
FIG. 14 is a sectional view taken along the line XIV—XIV in FIG. 13.

In still another embodiment of the invention shown in FIGS. 12–14, the angle $\theta$ at which the electromagnetic means 99 of the embodiment shown in FIG. 11 is inclined can be varied by means of a hydraulic cylinder 115 serving as drive means, so as to obtain uniform distribution of the points at which the molten metal begins to come into contact with the inner surface of the mold tube along the entire periphery irrespective of changes in the static pressure in the vicinity of the boundary 17.

The electromagnetic field generating means 99 is located in a box 116 formed of nonmagnetic material and having inert gas charged therein. The box 116 is fixedly mounted inside a cooling box 117 formed of nonmagnetic material and having cooling water flowing therein. The cooling box 117 has secured thereto at its outer periphery a pair of trunnions 118 and 119 extending perpendicular to the axis of the tundish nozzle 14 in a horizontal direction. The trunnions 118 and 119 are journalled by trunnion bearings 120 and 121 securedly supported on the mold 3 respectively.

The trunnions 118 and 119 are each in the form of a hollow cylinder, and a cylindrical member 122 connected to the box 116 projects outwardly through the trunnion 118. The cylindrical member 122 has its outer end portion closed to allow a tubular member 123 to extend therethrough outwardly concentrically of the cylindrical member 122 for connecting a cable inserted therein to the electromagnetic field generating means 99. The tubular member 123 has connected thereto at its end portion a current supply cable 125 through a rotary joint 124. The cylindrical member 122 has connected thereto at an outer end portion a gas supply hose 127 through the rotary joint 126. Moreover, the pressure at which the sealed gas is supplied is set at a level higher than the pressure of the cooling water. By this arrangement, trouble such as leaks can be prevented that might otherwise be caused by inflow of the cooling water into the box 116 due to incomplete sealing of the box 116.

The cooling box 117 is partitioned by a partition plate 128 on the axis of the other trunnion 119. A water supply line 129 and a water discharge line 130 are inserted in the trunnion 119 and they are connected at one end portion to the cooling box 117 on opposite sides of the partition plate 128 and project outwardly at the other end portion after coaxially extending through the trunnion 119. The water supply line 129 has connected thereto at the other end portion a water supply hose 132 through a rotary joint 131 while the water drain line 130 has connected thereto at the other end portion a water drain hose 134 through a rotary joint 133. Thus the cooling water is discharged after flowing in substantially one circulation in the cooling box 117.

The hydraulic cylinder 115 has an axis parallel to the mold 3 and secured thereto in the vicinity of the trunnion 119. Secured to an intermediate portion of the trunnion 119 is a radially outwardly extending drive lever 135 which is connected by a pin at its outer end portion to the forward end portion of a piston rod 136 of the drive means 115. Thus, by driving the hydraulic cylinder 115 for a reciprocatory movement, the trunnions 118 and 119 each rotate about its axis to allow the electromagnetic field generating means 99 to move in swinging movement in a direction shown by an arrow 137. Thus, the angle $\theta$ formed by the electromagnetic field generating means 99 with respect to the axis of the mold 3 can be adjusted as desired.

Position sensing means 138 and 139 for sensing the points at which the molten metal begins to come into contact with the inner surface of the mold tube 33 are provided in the upper and lower portions respectively of the mold tube 33 in the vicinity of the end portion thereof adjacent the tundish nozzle 14. The outputs of the position sensing means 138 and 139 are supplied to a control means, not shown, of a construction similar to that of the aforesaid control means 32 shown in FIG. 8. The control means controls the cylinder 115 to obtain uniform distribution of the molten metal contact initiating points in the upper and lower portions of the mold tube 33 with respect to the axis of the mold 3. In this case also, by effecting adjustments of the power supply of the electromagnetic field generating means 99 in addition to the adjustments of the angle $\theta$, it is possible not only to allow the molten metal contact initiating points in the upper and lower portions of the mold tube 33 to be brought into agreement with each other but also to let such points coincide with the predetermined set point.

In this embodiment, adjustments of the inclination angle $\theta$ of the electromagnetic field generating means 99 can be readily effected. The use of the trunnions as a support structure enables supply of a current and supply and discharge of water to be readily obtained. Moreover, the heat generated by the electromagnetic field generating means 99 and the heat transferred to the electromagnetic field generating means 99 from the molten metal 12 can be absorbed by the cooling water, thereby preventing overheating of the electromagnetic field generating means 99. Furthermore, as the electromagnetic field generating means 99 is supported on the mold side, the arrangement is convenient for the electromagnetic field generating means 99 to receive a reaction from the molten metal 12. When the mold 3 is made to vibrate, it is necessary to support the electromagnetic field generating means 99 on a supporter of a mold vibrating device.

Figure 15:
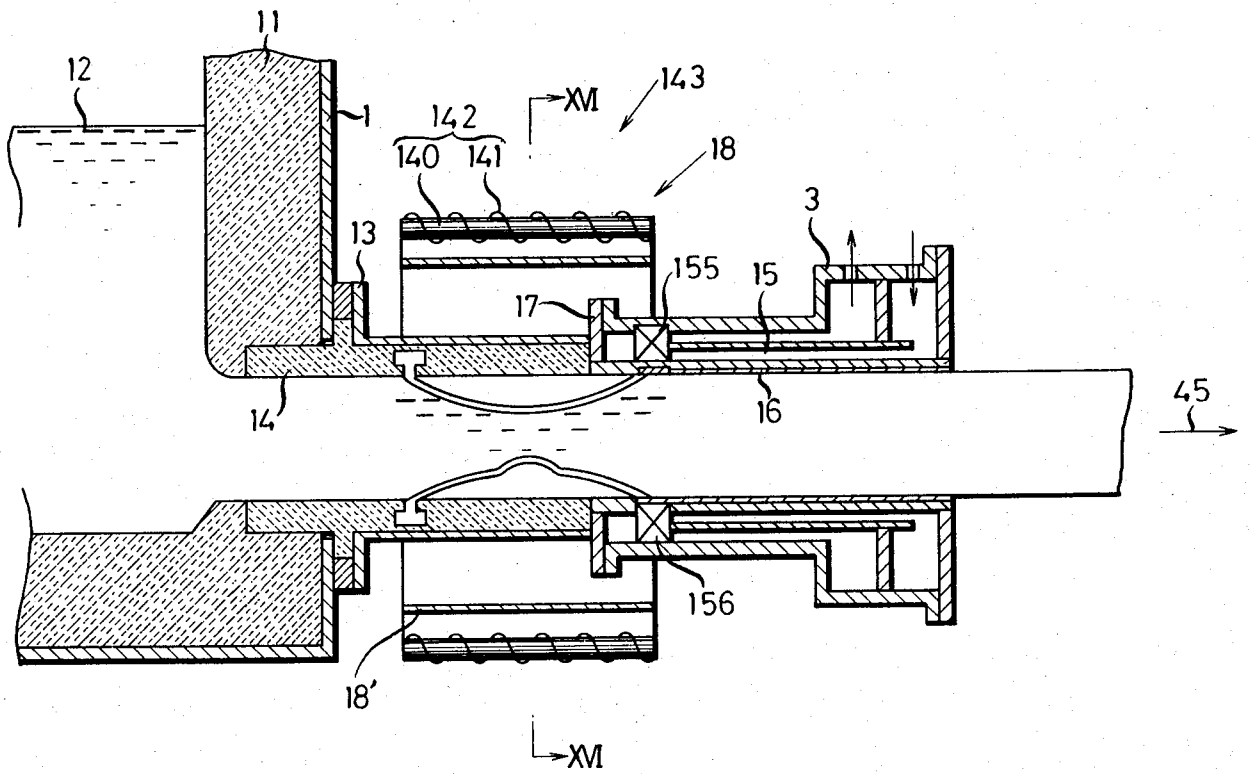
FIG. 15 is a sectional view of still another embodiment.
Figure 16:
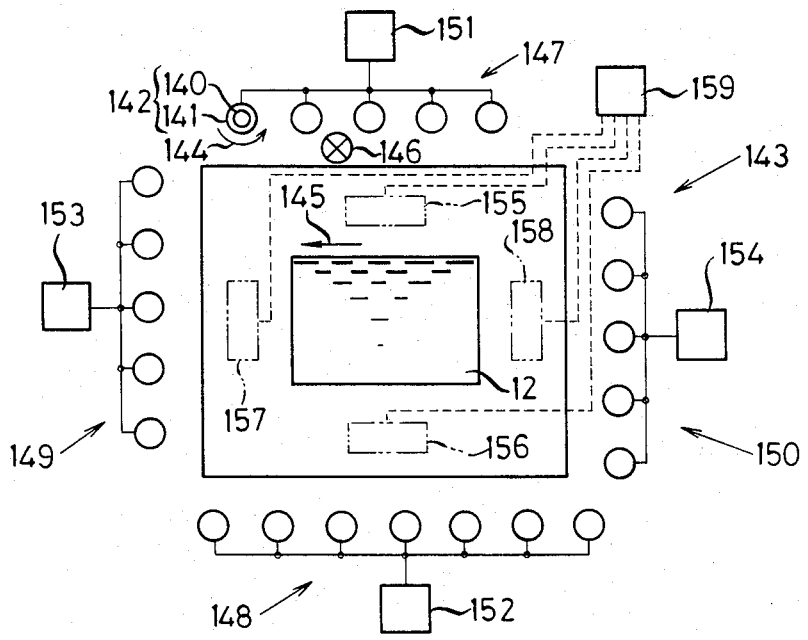
FIG. 16 is a sectional view taken along the line XVI—XVI in FIG. 15.

The embodiment shown in FIGS. 15 and 16 comprises an electromagnetic field generating means 143 including a plurality of electromagnetic field generating elements 142 located in along the periphery and each composed of a coil 141 wound on a coil 140 extending axially of the mold 3 and the tundish nozzle 14. The electromagnetic field generating elements 142 are arranged closer to one another in the lower portion of the molten metal 12 than in the upper portion thereof, so as to provide the lower portion of the molten metal 12 with a magnetic flux of higher density than the upper portion thereof. When a current is passed through the coil 141 in the direction of an arrow 144, an eddy current is applied to the molten metal 12 in the direction of an arrow 145. The numeral 146 designates the direction of a magnetic field generated by such electromagnetic generating element 142. Thus, a radially inwardly directed magnetic force is applied to the molten metal 12 to reduce its transverse dimension.

In the electromagnetic field generating means 143 described hereinabove, the electromagnetic field generating elements 142 are divided, as shown in FIG. 16, into a plurality of groups or four groups 147, 148, 149 and 150 which are located on the upper side, lower side, left side and right side respectively. Power sources 151, 152, 153 and 154 are connected to the groups 147, 148, 149 and 150 respectively. The mold tube 33 has position sensing means 155, 156, 157 and 158 corresponding to groups 147, 148, 149 and 150, respectively. Contact initiating points of the molten metal 12 sensed by the position sensing means 155–158 are inputted to control means 159. The control means 159 effects control of power supply from the power sources 151–154 in such a manner that the contact initiating points agree with the predetermined point with respect to the axis of the mold 3.

The embodiment described hereinabove enables the contact initiating points of the molten metal to be brought into coincidence with the predetermined point along the entire periphery and also enables cooling of the molten metal 12 to be effected uniformly along the entire periphery, to thereby make it possible to produce a sound strand.

Figure 17:
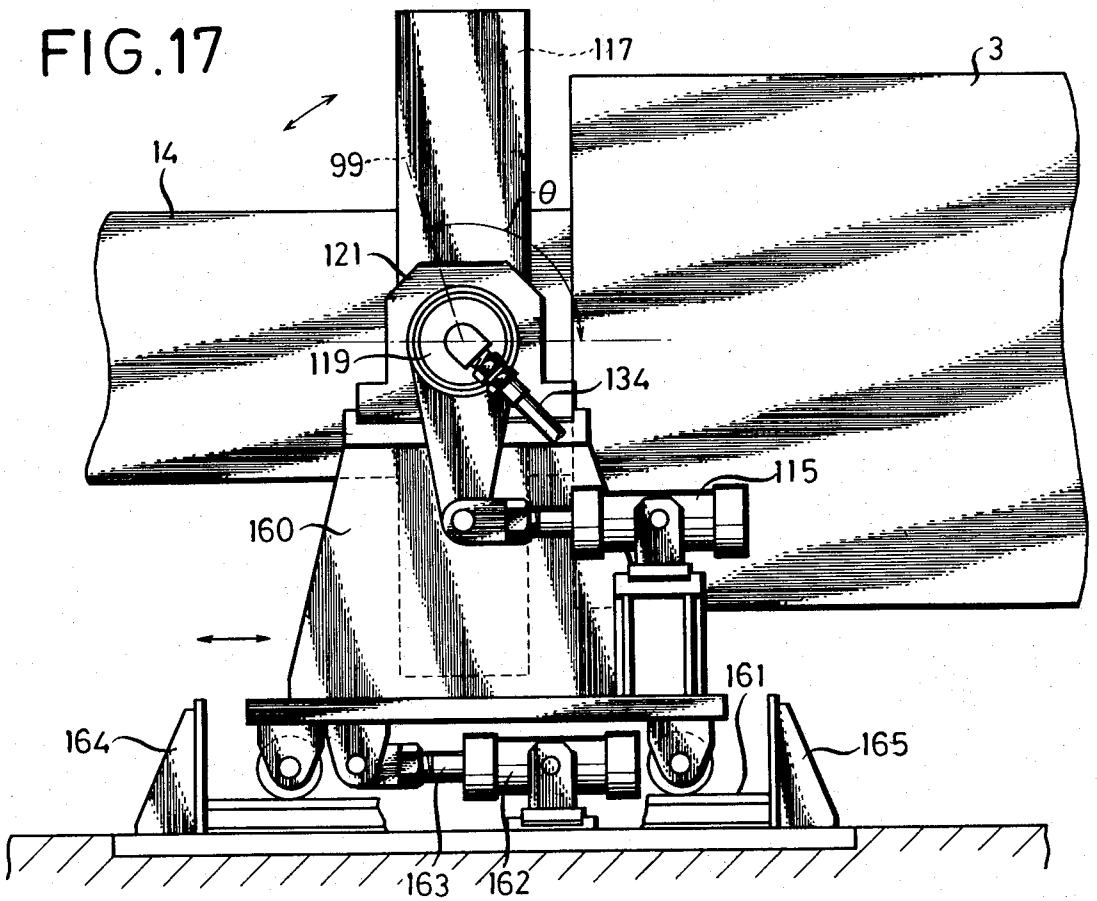
FIG. 17 is a side view of still another embodiment.

FIG. 17 shows an embodiment in which the electromagnetic field generating means 99 of the embodiment described by referring to FIGS. 12–14 is movable axially of the mold 3. That is, trunnion bearings 120 and 121 and the hydraulic cylinder 115 supported on a support truck 160. Rails 161 are located below the tundish nozzle 14 and the mold 3 and extend parallel to the tundish nozzle 14 to allow the support truck 160 to move freely thereon. Fixedly secured below the truck 160 is a hydraulic cylinder 162 having its axis disposed parallel to that of the rails 161 and including a piston 163 connected by a pin to the truck 160. Thus, by driving the hydraulic cylinder 16 for reciprocatory movement, the support truck 160 can be moved on the rails 161 between two stoppers 164 and 165 on opposite ends, to allow the electromagnetic field generating means 99 to move axially of the tundish nozzle 14.

In this embodiment, the electromagnetic field generating means 99 can be moved along the withdrawing direction 45, so that it is possible to vary the contact initiating points of the molten metal 12 and hence to change the cooling condition.

Like the embodiment shown in FIG. 17, movement of the electromagnetic field generating means 99 in the withdrawing direction 45 can also be readily obtained in the embodiments shown in FIGS. 4–8 and FIGS. 15 and 16.

In still another embodiment of the invention, the position sensing means 25, 34, 35, 109, 138, 139, 155, 156, 157 and 158 of the embodiments described hereinabove for sensing the contact initiating points of the molten metal may be dispensed with, and adjustments of the electromagnetic force may be effected only by using the shell gauges 91 and 92 located at the outlet of the mold 3 to control power supply and the distance covered by the movement of the electromagnetic field generating means 18, 98, 99 and 143.

In the foregoing description of each of the embodiment, a horizontal continuous casting process has been described wherein control of the electromagnetic force applied by the electromagnetic field generating means to the molten metal 12 for correcting variations at the points at which the molten metal comes into contact with the inner surface of the mold tube 33 caused by changes in static pressure in the vicinity of the boundary between the tundish nozzle 14 and mold 3 is effected in feedback operation in such a manner that the results of the changes in static pressure manifesting themselves as variations in the molten metal contact initiating points on the inner surface of the mold tube 33 or the condition of cooling of the molten metal at the outlet of the mold 3 are sensed and made to agree with the target values.

However, it will be apparent that the aforesaid electromagnetic field generating means may be controlled such that the electromagnetic force is varied in a manner to correct variations in the static pressure in the vicinity of the boundary. That is, one only has to control the electromagnetic field generating means in such a manner that when the static pressure acting on the surface layer of the molten metal in the vicinity of the boundary becomes high in value, the aforesaid electromagnetic force is increased; when such static pressure becomes low in value, the electromagnetic force is decreased.

The static pressure is proportional to a head of the molten metal, so that by sensing the liquid level of a body of the molten metal in the tundish, it is possible to learn the static pressure with ease. Also, if difficulties are encountered in directly sensing the liquid level of the molten metal in the tundish, it is possible to indirectly estimate the liquid level of the molten metal by measuring the weight of the body of the molten metal in the tundish to measure the volume of the molten metal in the tundish.

Figure 18:
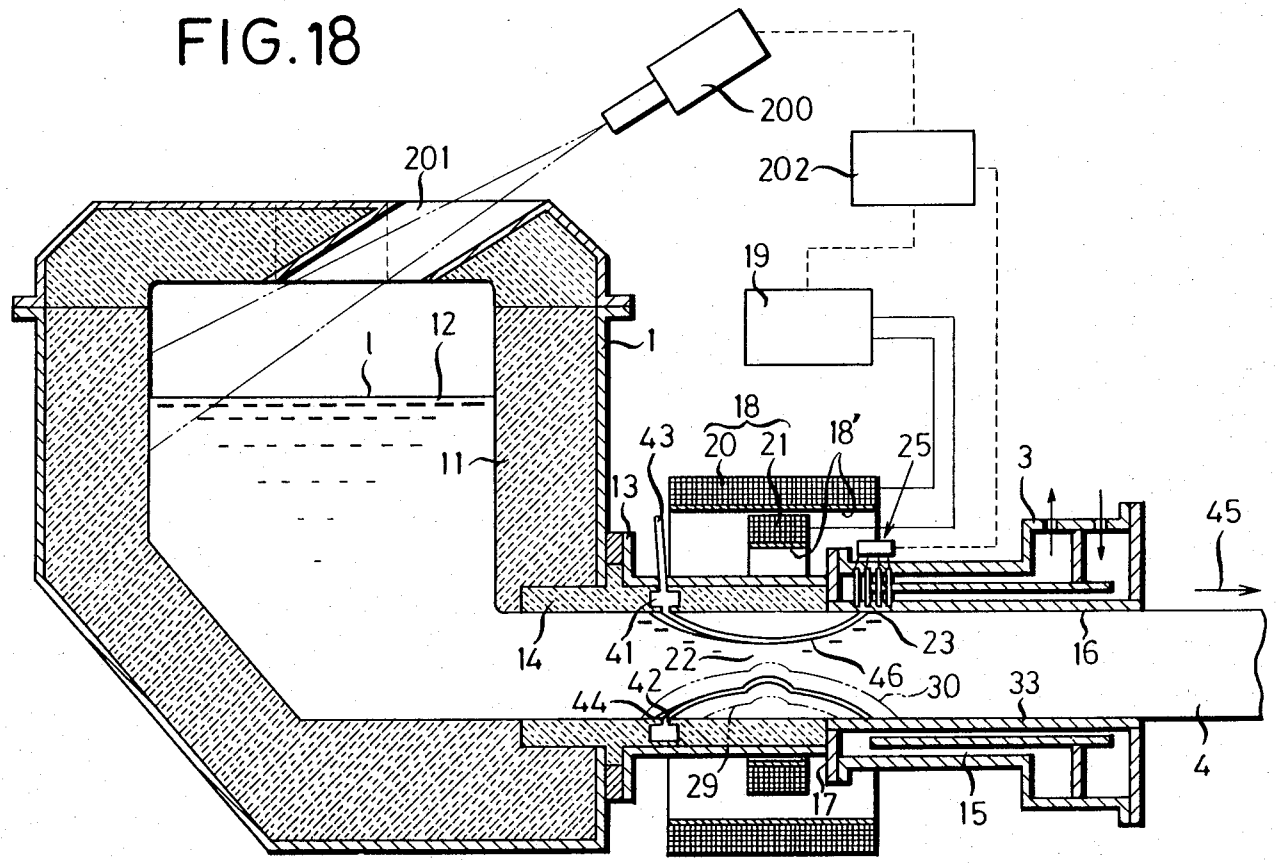
FIG. 18 is a vertical sectional view of still another embodiment.

FIG. 18 shows an embodiment comprising, to effect the aforesaid adjustments of the liquid level, a TV camera 200 for sensing a level l of the molten metal in the tundish. The TV camera 200 monitors an interior of the tundish 1 through an opening 201 formed in the upper portion of the tundish 1 and senses the level l to transfer same to control means 202. The control means 202 controls the power source 19 for supplying power to the electromagnetic field generating means 18 in accordance with changes in the level l, to adjust power supply. Moreover, position sensing means 25 similar to that of the embodiment shown in FIG. 2 is used for sensing the contact initiating points located in a portion of the mold 3 close to the tundish nozzle 14. The position sensing means 25 senses the contact initiating positions and the power supply is adjusted to bring the contact initiating points into agreement with the predetermined set point 23.

Figure 19:
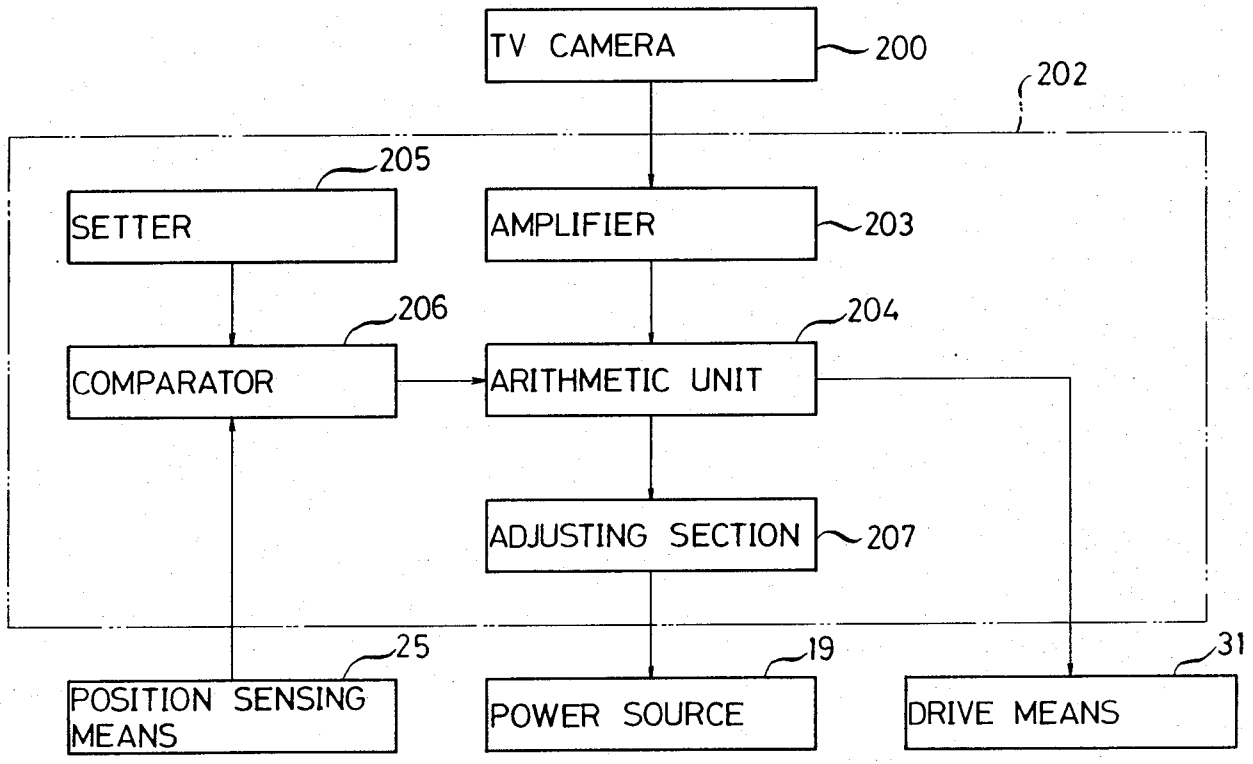
FIG. 19 is a schematic block diagram showing the construction of the control means of the embodiment shown in FIG. 18.

FIG. 19 is a simplified block diagram of a control device 202, showing the construction thereof. The level l sensed by the TV camera 200 is transmitted to an arithmetic unit 204 through an amplifier 203. In the arithmetic unit 204, calculation is done in accordance with a predetermined program on a power supply corresponding to the liquid level of the molten metal in the tundish. Meanwhile a setter 205 generates a signal corresponding to the predetermined contact initiating point 23 which is compared with the signal from the position sensing means 25 in a comparator 26 which produces and supplies a signal to the arithmetic unit 204 which produces a signal as the result of calculation and supplies same to an adjusting section 207, so as to thereby adjust the power supply.

The power supply to the first coil 20 or the second coil 21 is controlled in this way to bring the contact initiating points into coincidence with a predetermined set point. Thus, the contact initiating point of the molten metal 12 and the separation initiating point thereof are kept constant irrespective of the level l, and the length of cooling zone of the molten metal 12 in the mold 3 is kept constant to enable a sound strand to be obtained with no variation in the thickness of the shell of solidification. Also the nozzle 42 for the lubricant is prevented from being obturated by the molten metal 12.

In this case also, as described by referring to FIGS. 4–7, position sensing means may be mounted at the upper and lower inner surfaces of the mold tube 33 and in addition the drive means 31 for the second coil 21 may be mounted, and the sensed upper and lower contact may be inputted to the control device 202 to control the second coil drive means 31. By controlling the drive means 31 for driving the second coil, reduced diameter portion 22 can have its cross-sectional shape made similar to and concentric with that of the mold tube 33, so that it is possible to minimize variations in the contact initiating points of the molten metal in its upper and lower portions and also to minimize changes in the cooling condition of the molten metal.

To minimize changes in the level l, the drive portion 32 of the sliding gate 31 located in a lower portion of the ladle 8 (see FIG. 1) may be controlled based on the signal produced by the arithmetic unit 204. When this is the case, flow of the molten metal into the tundish 1 can be controlled, to thereby enable changes in the level l to be minimized.

Figure 20:
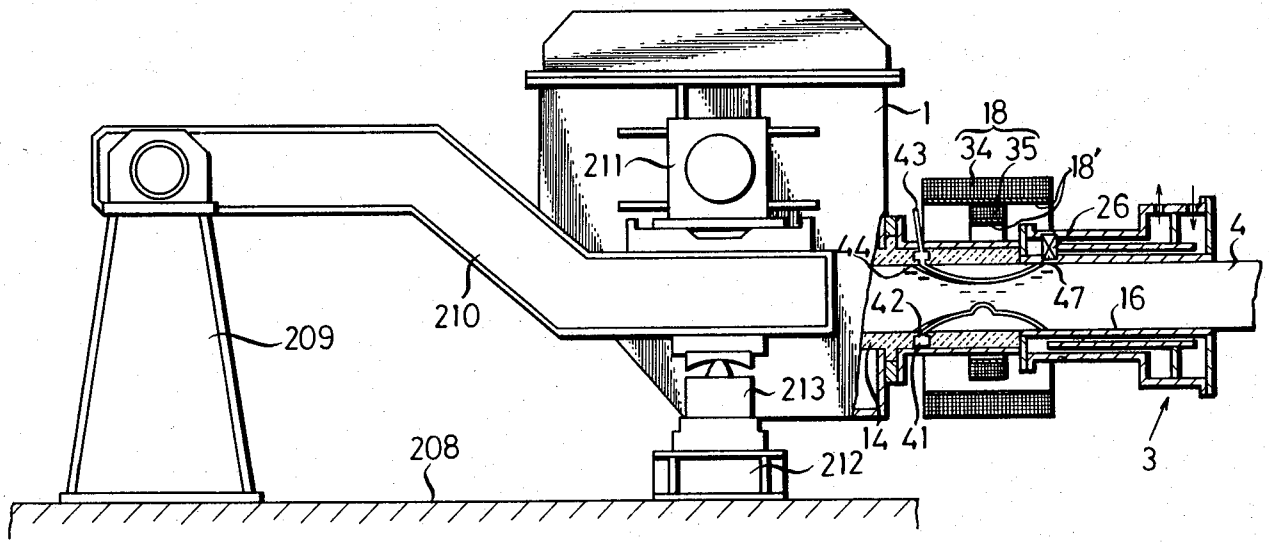
FIG. 20 is a side view of still another embodiment, showing portions thereof in section.
Figure 21:
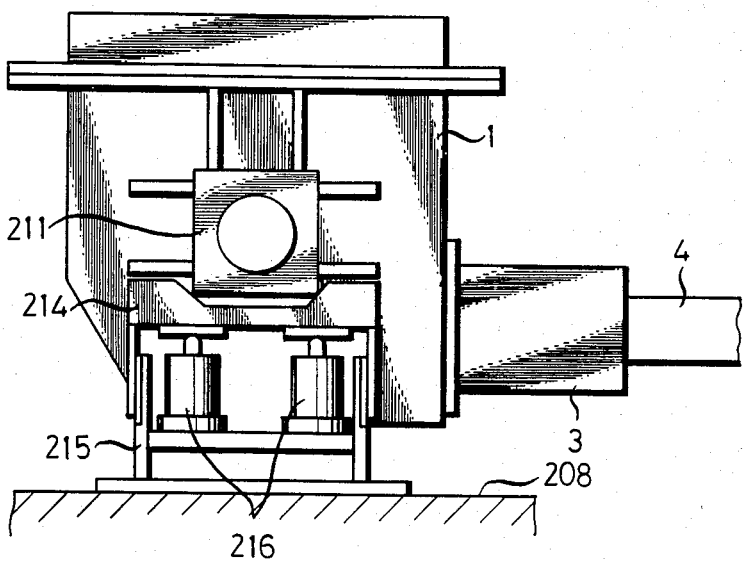
FIG. 21 is a side view of still another embodiment.

FIGS. 20 and 21 show embodiments wherein the weight of the body of molten metal in the tundish 1 is measured together with the tundish 1 by a load cell 213 or 219, to obtain the volume of the molten metal in the tundish 1 to thereby make an estimate of the liquid level in the tundish 1.

In the embodiment shown in FIG. 20, an support arm 210 is pivotably supported at one end portion through a pin by a support post 209 located in upright position on a support 208. The support arm 210 is extended at the other end portion to support thereon a support projection 211 on the tundish 1. The other end portion of the arm 210 is supported by the load cell 213 placed on a holder 21. By virtue of this arrangement, the volume of the molten metal 12 stored in the tundish 1 is sensed by the load cell 213 to thereby determine the liquid level. An electromagnetic force generated by the first coil 20 or the second coil 21 can be altered in the same manner as described by referring to the embodiment shown in FIG. 18 in accordance with changes in the liquid level or changes in the static pressure in the vicinity of the boundary.

In the embodiment shown in FIG. 21, a support member 214 supporting thereon a projection 211 attached to the tundish 1 is movable in a vertical direction and can be brought into sliding engagement with guide members 215 mounted in an upright position on the support 208, such support member 214 supporting the load cell 216 thereon.

In the continuous casting installation for producing a strand of a large cross section described by referring to FIG. 11, the power supply to the electromagnetic field generating means 98 and 99 may be controlled in accordance with changes in the liquid level of the molten metal in the tundish 1. This enables the point 112 at which the molten metal begins to separate itself from the tundish nozzle 14 to be kept substantially constant.

In the process for effecting adjustments of power supply to the electromagnetic field generating means in accordance with the liquid level of the molten metal in the tundish, the contact position sensing means 23 and 109 are not essential and may be dispensed with.

Figure 4:
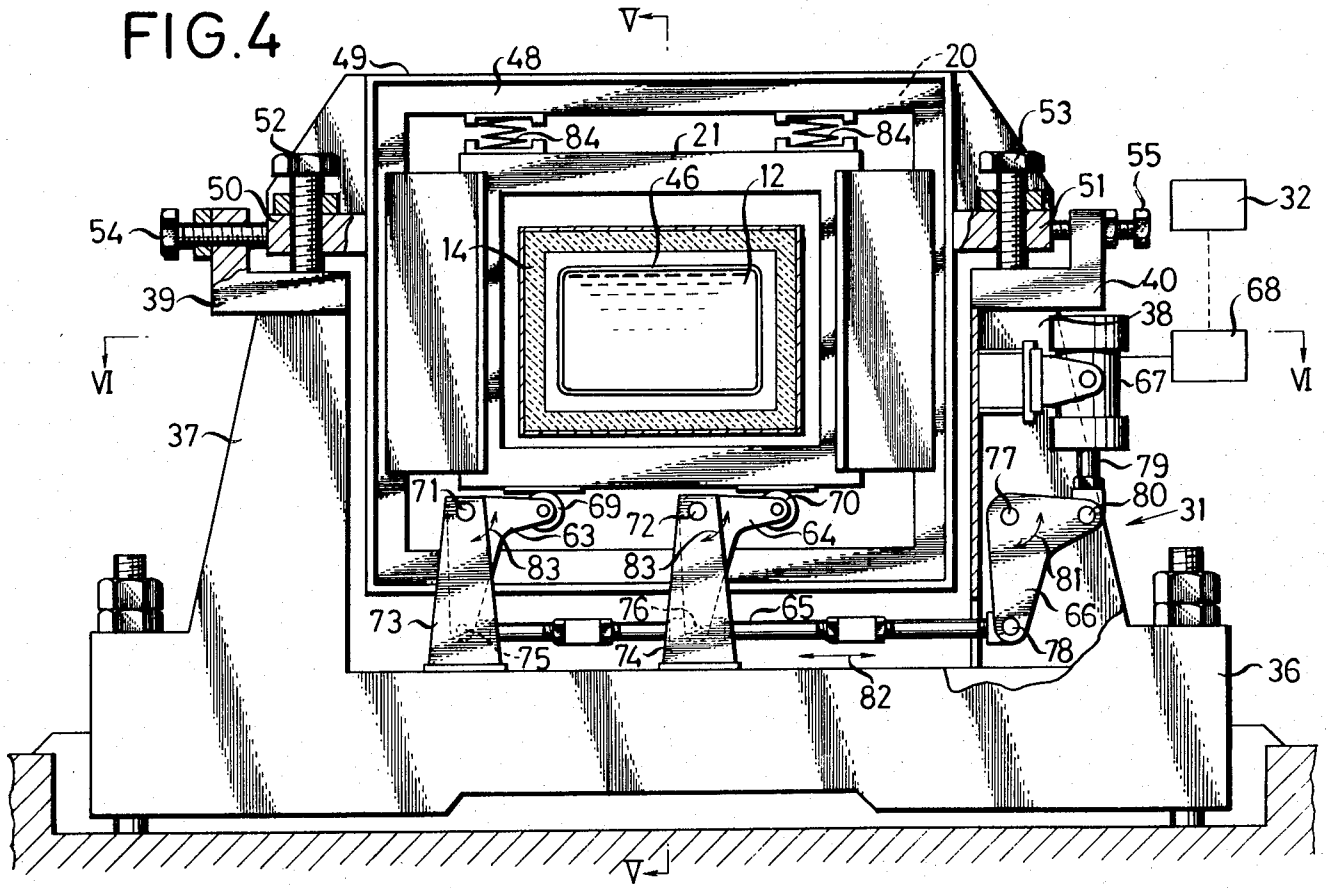
FIG. 4 is a sectional view of the horizontal continuous casting installation comprising still another embodiment.
Figure 5:
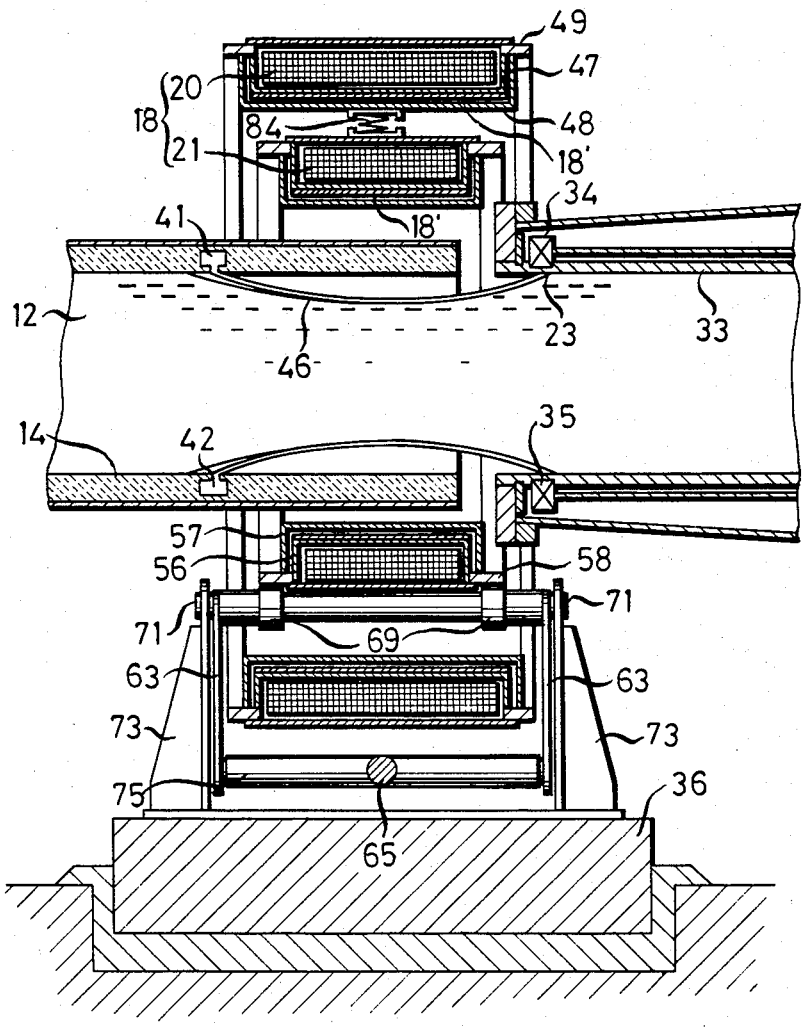
FIG. 5 is a sectional view taken along the line V—V in FIG. 4.
Figure 6:
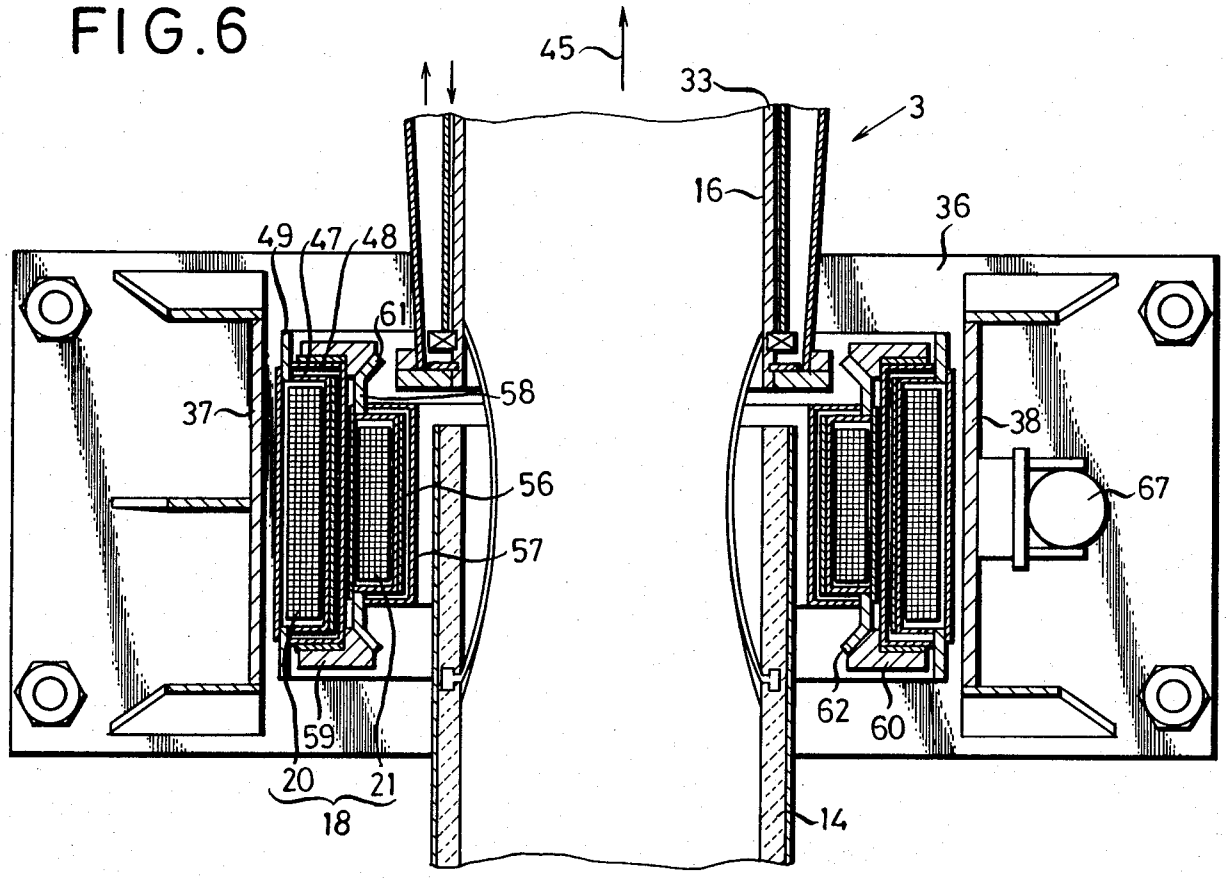
FIG. 6 is a sectional view taken along the line VI—VI in FIG. 4.
Figure 7:
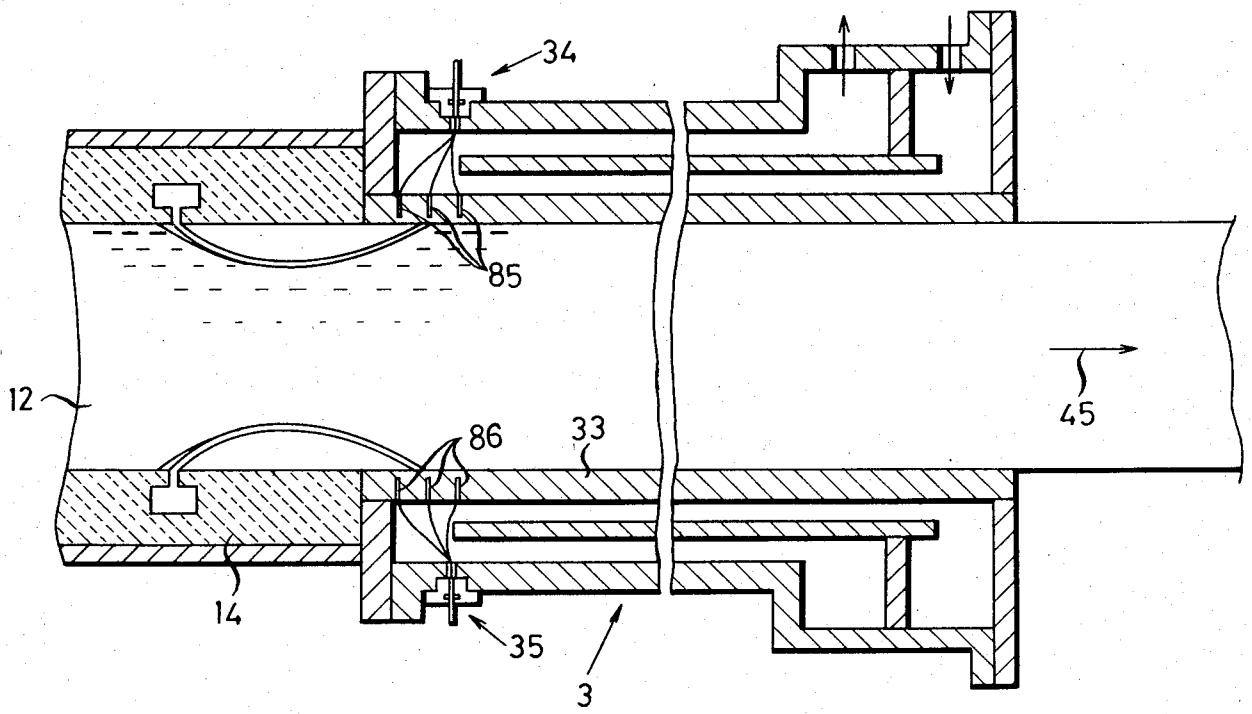
FIG. 7 is a vertical sectional view of the embodiment shown in FIG. 4, showing portions of the installation in the vicinity of the mold.

In the embodiment shown in FIGS. 4, 5, 6; 11; 12, 13, 14; and 17, the length of the molten metal in contact with the inner surface of the mold tube 33 is made uniform by obtaining uniform distribution of the molten metal contact initiating points on the inner surface of the mold with respect to the axis, so as to allow the molten metal to be cooled uniformly along the entire periphery thereof. However, a static pressure applied to the molten metal in the mold is higher in the lower portion of the molten metal than in the upper portion thereof. Thus, the pressure at which the molten metal is brought into contact with the inner surface of the mold tube becomes higher in the lower portion of the molten metal than in the upper portion thereof. This causes cooling effects achieved to become higher in the lower portion of the mold tube 33 than in the upper portion thereof.

Figure 22:
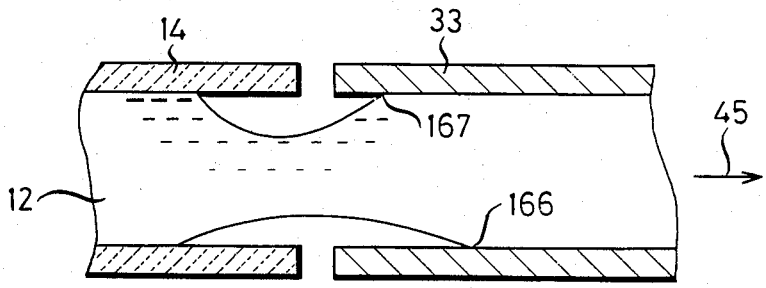
FIG. 22 is a vertical sectional view of another embodiment, showing the concept on which still another embodiment is based.

Therefore, strictly speaking, obtaining uniform cooling of the molten metal along its entire circumference requires controlling the point at which the molten metal begins to come into contact with the lower inner surface of the mold tube 33 to be located at a point anterior to the point 167 at which the molten metal begins to come into contact with the upper inner surface of the mold tube 33 with respect to the withdrawing direction 45, as shown in FIG. 22. By virtue of this arrangement, the length of contact between the molten metal 12 and the mold tube 33 can be varied between the upper portion and the lower portion to enable the difference in cooling effects to be compensated for and allow the cooling conditions to be rendered uniform along the entire periphery of the molten metal 12, thereby rendering the thickness of the shell uniform along the entire circumference.

To effect uniform cooling of the molten metal along the entire circumference thereof, besides altering the length of contact between the molten metal and the inner surface of the mold tube in the upper and lower portions, an electromagnetic force may be applied to the molten metal which corresponds to the distribution of static pressures acting on the surface layer of the molten metal and yet acting in a direction opposite the direction in which the static pressure acts, so that the difference between the static pressure and the electromagnetic force or the pressure at which the molten metal is brought into contact with the inner surface of the mold tube becomes uniform along the entire circumference.

This is conducive not only to elimination of nonuniform cooling of the molten metal but also to obviation of the problem stated in the opening paragraphs that nonsymmetrical wear and nonuniform lubrication stemming from nonuniform contact pressure between the molten metal and the inner surface of the mold occur.

Figure 23:
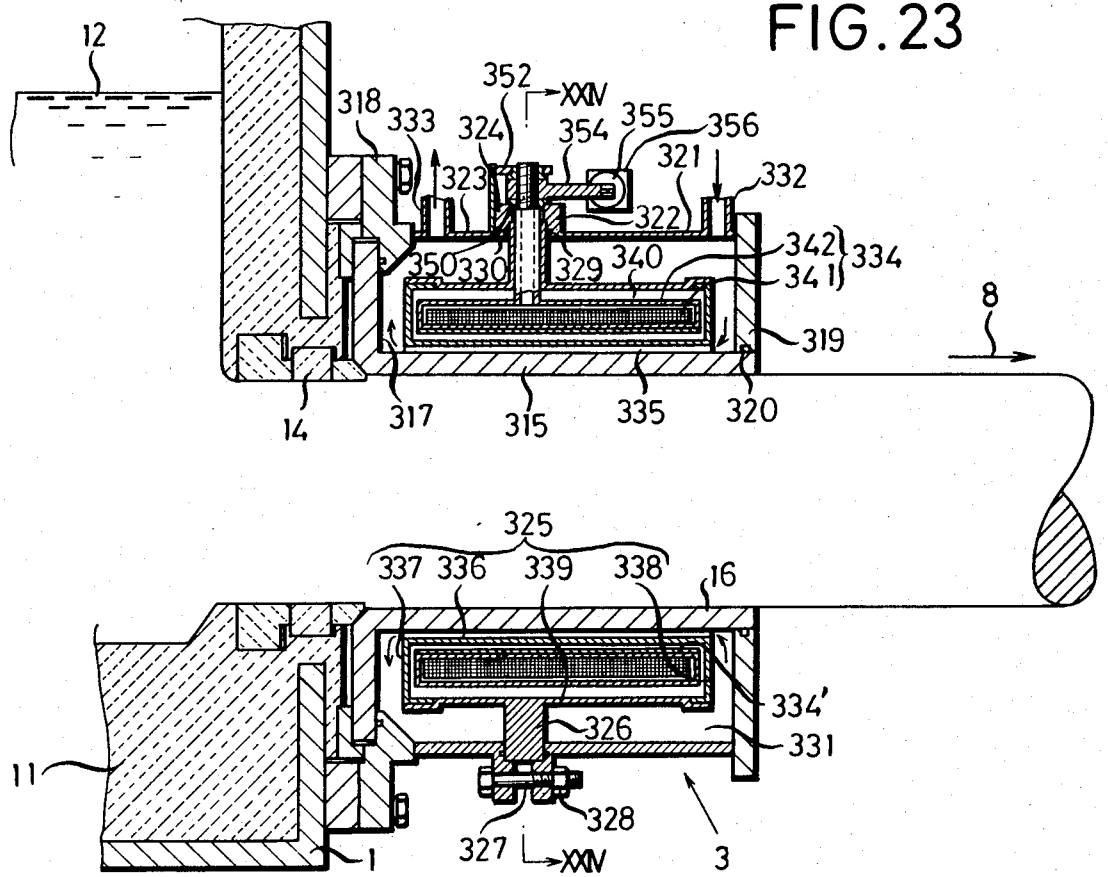
FIG. 23 is a vertical sectional view of still another embodiment.
Figure 24:
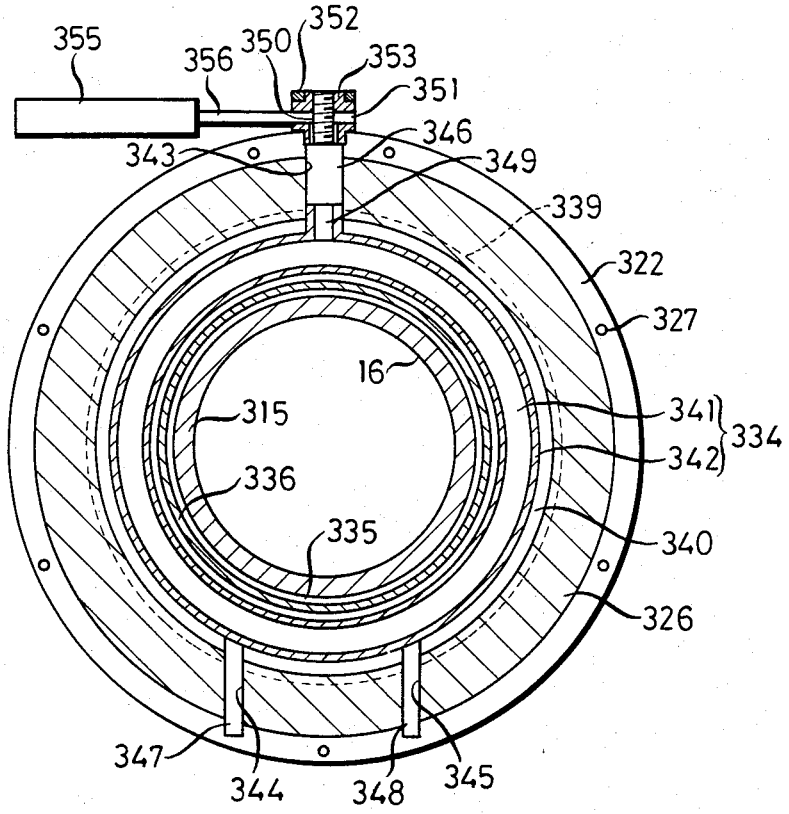
FIG. 24 is a sectional view taken along the line XXIV—XXIV in FIG. 23.

The embodiment shown in FIGS. 23 and 24 is based on this concept.

In the installation shown, the tundish 1 has a lining of refractory material and contains the molten metal 12 therein. The tundish 1 has fixedly connected thereto at its lower portion the tundish nozzle 14 formed of refractory material. The mold 3 is equipped with a cylindrical mold tube 315 formed of copper constituting a continuous passage concentric with the tundish nozzle 14. The mold tube 315 is integrally formed at its axial one end with an outwardly directed flange 317. By attaching the outwardly directed flange 317 to the tundish 1 through a mounting member 318, the mold tube 315 and the tundish nozzle 14 are fixedly connected to each other.

The mold tube 315 has watertightly inserted at the other axial end with an outwardly directed flange 319 through a seal member 320. The outwardly directed flange 319 has secured thereto a cylindrical frame 321 extending toward the axial one end of the mold tube 315 in enclosing relation to the mold tube 315. The frame 321 is integrally formed at its end with an outwardly directed flange 322. The mounting member 318 has secured thereto a cylindrical frame 323 concentric with the frame 321 and of the same diameter therewith which extends axially of the mold tube 315 at its other end portion in enclosing relation thereto. The frame 323 is integrally formed at its end with an outwardly directed flange 324 located in opposing relation to the flange 322. The flanges 322 and 324 are connected together by a bolt 327 and a nut 328 through an outwardly directed flange 326 formed integrally with a box 325. The flanges 322 and 324 and opposite surfaces of the outwardly directed flange 326 have interposed therebetween ring-shaped seal members 329 and 330 respectively, to form a cooling liquid passage 331 enclosing the mold tube 315. The one frame has connected thereto a liquid supply line 332 for supplying a cooling liquid or a cooling water while the other frame 323 has connected thereto a discharge line 333 for draining the cooling water.

Mounted in the cooling liquid passage 331 is the box 325 formed of nonferromagnetic steel plate, such as austenite stainless steel, for containing electromagnetic field generating means 334. The box 325 includes an inner cylindrical portion 336 enclosing the mold tube 315 by cooperating with the outer surface of the mold tube 315 to form therebetween an annular gap 335, radially outwardly extending end plate portions 337 and 338 formed integrally at axial opposite ends of the inner cylinder portion 336, and an outer cylinder portion 339 enclosing the inner cylinder portion 336 which has its opposite ends fixedly connected to the end plate portions 337 and 338. Formed in the box 325 is a housing space 340 airtightly separated from the cooling liquid passage 331 and having dry gas or liquid of insulating property sealed therein or flowing in circulation therethrough.

The electromagnetic field generating means 334 which is mounted in the housing space 340 for vertical displacement comprises a substantially annular coil 341 enclosing the mold tube 315, and a support frame 342 supporting the coil 341 thereon. Placed inwardly of the electromagnetic field generating means 334 is an induced current absorbing plate 334' for preventing reverse flow of an induced current when an energizing current is reduced in value.

The outwardly directed flange 326 of the box 325 is formed at its uppermost portion with a guide slot 343 (FIG. 24) extending in a vertical direction. The outwardly directed flange 326 is formed at its lower portion with a pair of slots 344 and 345 extending in a vertical direction and located symmetrically with respect to a vertical plane including the axis of the box 325. The support frame 342 has connected thereto trunnions 346, 347 and 348 slidably inserted into the guide slots 343, 344 and 345 respectively in the axial direction for displacement. The trunnion 345 is formed with a cable leading-in opening which has a cable, not shown, inserted therein for applying an energizing current to the coil 341.

The trunnion 346 extends outwardly between the outwardly directed flanges 322 and 324 and is formed at its outer end portion with an external screw thread 350 which threadably engages a disc-shaped rotary member 351. The frame 323 has secured at its uppermost portion a support member 352 for mounting between the support member 352 and the flanges 322 and 324 a seat for preventing the rotary member 351 from moving in a vertical direction but allowing its rotation about the trunnion 346.

The rotary member 351 has connected thereto a lever 354 extending radially outwardly which has connected at its outer end through a pin a piston rod 356 of a cylinder 355. Thus, by actuating the cylinder 355, the rotary member 351 can be made to rotate about the trunnion 346 to move the latter in a vertical direction. Stated differently, the trunnion 346 is kept from rotating about its axis by the pair of trunnions 347 and 348 located in a lower portion of the support frome 342, and only allowed to move in the vertical direction along the guide slot 343. Since the rotary member 351 is kept from moving up and down, the trunnion 346 moves in the vertical direction as the rotary member 351 rotates, thereby allowing the electromagnetic field generating means 334 to move upwardly and downwardly in the housing space 340.

FIG. 25(*a*) shows the static pressure distribution applied to the surface layer of the molten metal 12 of a circular cross section in the mold 3. Since a static pressure proportional to a head of the molten metal acts on the molten metal 12 in the mold 3 as shown in FIG. 25(*b*), a static pressure increasing in value in going toward the lower portion of the molten metal 12 from the upper portion thereof as shown in FIG. 25(*a*) acts on the surface layer of the molten metal 12. As can be clearly seen in FIG. 25(*a*), the surface layer of the molten metal 12 is acted on by a static pressure applied along a curve 361 which substantially corresponds to an imaginary circle 360 centered at a point 359 slightly below the center point 358 of the molten metal but slightly bulging transversely from the imaginary circle 360.

As shown in FIG. 25(*a*), when a static pressure applied to the molten metal along the circumferential direction is not uniform, a pressure at which the molten metal 12 is brought into contact with the inner surface of the mold tube 15 becomes nonuniform corresponding to the static pressure distribution as aforesaid. Therefore, according to the invention, the difference in static pressure is compensated for by an electromagnetic force generated by the coil 341 of the electromagnetic field generating means 334 to obtain uniform contact pressure distribution along the entire circumference of the molten metal.

Referring to FIG. 26, a coil is arranged along the circumference of a circle 366 centered at a point 362 disposed slightly above center point 358 of the molten metal 12. An electromagnetic force acting on the surface layer of the molten metal 12 is in inverse proportion to the distance between the coil and the surface layer of the molten metal 12, so that the electromagnetic forces becomes higher in value in going toward the lower portion of the molten metal 12, as indicated by an arrow in solid lines. However, the distribution of the electromagnetic forces corresponds to a curve 365 substantially concaved transversely of an imaginary circle 364 centered at a point 363 below the center point 356. As described by referring to FIG. 25(*a*) hereinabove, the static pressure distribution slightly bulges transversely of the imaginary circle 361. Thus by using the electromagnetic forces having the distribution shown in FIG. 26 to effect compensation for the difference in the static pressure applied to the molten metal 12 circumferentially thereof, it is possible to obtain a uniform contact pressure distribution applied to upper and lower portions of the molten metal 12. However, the contact pressure applied to the opposite side portions of the molten metal 12 becomes higher in value than the contact pressure applied to the upper and lower portion thereof.

Thus, the coil 341 is arranged as shown in FIG. 27, to allow the electromagnetic force generated thereby to be distributed substantially as represented by a curve 367 similar to the curve 361 shown in FIG. 25(*a*). That is, the coil 341 is arranged in substantially elliptic form slightly bulging transversely of the circle 366 referred to hereinabove, with the center of the coil 341 in elliptic form being located slightly above the center 358 of the molten metal 12. By virtue of this arrangement, the distribution of the electromagnetic force is represented by a curve 367. The curve 367 is similar to the curve 361 showing the distribution of the static pressures shown in FIG. 25(*a*), so that the contact pressures obtained by subtracting the electromagnetic force from the static pressure becomes uniform peripherally of the mold 3 as indicated by a broken line arrow shown in FIG. 27. The electromagnetic force supplied by the coil 341 is selected such that a satisfactory contact pressure is applied by the upper portion of the molten metal 12 to the inner surface of the mold tube 315.

Even if the coil 341 is arranged along an elliptic form slightly concaved from the circle 366 and centered at a point slightly displaced upwardly from the center point 358 of the molten metal, the contact pressure of the molten metal tends to become nonuniform peripherally thereof. As shown in FIG. 9, a plurality of shell gauges designated by the numerals 91 and 92, are mounted peripherally of the molten metal at the outlet end portions of the mold 3 for measuring the thickness of the shell of solidification formed at the surface layer of the molten metal 12. The contact pressure of the molten metal applied to the inner surface of the mold tube 315 is substantially proportional to the thickness of the shell of solidification, so that by measuring the thickness of the shell of solidification by means of the plurality of shell gauges as aforesaid, it is possible to determine the contact pressure distribution of the molten metal peripherally thereof. Thus, the cylinder 355 is actuated in a reciprocatory movement through control means, not shown, in a manner to render the thicknesses of the shell of solidification substantially equal. This vertically moves the electromagnetic field generating means 334 in the housing space 340, to thereby make it possible to alter slightly the electromagnetic force distribution acting on the surface layer of the molten metal 12. This enables a uniform distribution of the contact pressures applies by the molten metal 12 to the inner surface of the mold tube 315 to be obtained at all times.

In this embodiment, the molten metal 12 comes into contact the inner surface of the mold tube 315 with pressures uniformly distributed peripherally thereof, so that it is possible to effect cooling of the molten metal uniformly in the peripheral direction, to avoid nonsymmetrical wear that might otherwise be caused on the mold tube 315. Moreover, when the surface layer of the molten metal 12 is contracted by being cooled and forms a shell of solidification thereon, a gap between the surface of the shell of solidification and the inner surface of the mold tube can be maintained substantially constant peripherally thereof because the electromagnetic force acting on the molten metal 12 becomes higher in going to the lower portion from the upper portion. This allows peripherally uniform cooling of the molten metal to be obtained after shell forming. Furthermore, by virtue of the arrangement that the electromagnetic field generating means 334 is located inside the cooling liquid passage 331, adverse effects the heat released from the molten metal 12 might otherwise have on the coil 341 can be avoided, and the heat generated by the coil 341 is absorbed by the cooling water to thereby avoid overheating of the coil 341. The coil 341 is contained in the housing space 340 having dry gas sealed therein, so that no leaks occur and safety is assured. In place of sealing dry gas in the housing space 340, oil of insulating property may be made to flow in circulation through a coil box which might concurrently serve cooling purposes. A relatively narrow gap 335 is defined between the box 325 and the mold tube 315 for the cooling water to flow therein at a relatively high flow velocity, to enable improved cooling efficiency to be achieved. Moreover, a lubricant, not shown, is applied to the inner surface of the mold tube 315 to lubricate the surface layer of the molten metal 12 and the inner surface of the mold tube 315. Since the contact pressures of the molten metal 12 applied to the inner surface of the mold tube 315 are rendered peripherally uniform, substantially uniform distribution of the lubricant peripherally of the molten metal can be obtained in volume.

In place of the shell gauges referred to hereinabove, surface thermometers may be arranged at the outlet of the mold 3. The centering effect achieved with respect to the molten metal and the mold by foot rollers located at the mold outlet used with a vertical type continuous casting installation can be achieved contactless by arranging the electromagnetic force generating means in the mold according to the invention.

In still another embodiment, the mold tube 315 may be formed to have a cross section perpendicular to the axis which is rectangular. In this case, a static pressure distribution as shown in FIG. 28(*a*) acts on the surface layer of the molten metal 12. More specifically, a static pressure shown in FIG. 28(*b*) is in proportion to a head of the molten metal, so that the static pressures increasing in value in going toward the lower portion of the molten metal as shown in FIG. 28(*a*) acts on the surface layer of the molten metal 12. Thus, as shown in FIG. 29, by providing the coil 341 having a shape substantially symmetrical to the curve 372 showing a static pressure distribution in FIG. 28(*a*) with respect to center 370 of the molten metal 12, the electromagnetic force distribution is as shown by the curve 373 in FIG. 29. That is, an electromagnetic force distribution inwardly concaved at opposite sides of the molten metal 12 is obtained. If compensation for the static pressure shown in FIG. 28(*a*) is effected by the electromagnetic force distribution as indicated by the curve 373, the contact pressure of the molten metal 12 becomes relatively high at its opposite sides. By making the shape of the coil 341 concaved slightly inwardly at the opposite sides of the aforesaid curve, the electromagnetic force distribution will correspond to a curve 374 indicated by a broken line. The curve 374 is similar to the curve 372 indicating the static pressure distribution shown in FIG. 28(*a*). By using the coil 341 of this shape, it is possible to obtain a substantially uniform contact pressure distribution along the entire circumference between the surface layer of the molten metal 12 at the inner surface of the mold tube 315.

In still another embodiment of the invention, the electromagnetic field generating means 334 may be arranged radially of the mold 3 in a manner to enclose same without mounting same in the cooling liquid passage 331 of the mold 3. When this is the case, the distance between the electromagnetic field generating means 334 and the surface of the molten metal 12 becomes relatively large, and the power supply for energizing the coil 341 becomes relatively large in value.

In place of enclosing the mold tube 315 with a single coil along the entire periphery of the mold 3, the mold tube 315 may be enclosed by a plurality of coils arranged in tandem with respect to the axis of the mold tube 315. Furthermore, as shown in FIG. 30, a plurality of electromagnetic field generating means 334 each including a coil 376 wound on a core 375 extending axially of the mold tube 315 may be arranged in spaced-apart relation peripherally of the mold tube 315, with an induced current absorbing plate 377' being arranged therein. In this case, the electromagnetic field generating means 377 may be arranged in the same shape as the coil 341 described by referring to FIG. 29. Alternatively an electromagnetic force distribution similar to the curve 374 may be formed as indicated by a broken line in FIG. 29 by adjusting the power supply to the electromagnetic field generating means 377.

FIG. 31 is a perspective view of still another embodiment of the invention in which the mold tube 315 is rectangular shape having shorter vertical sides in which a vertical thickness $l_1$ is extremely smaller than its width $l_2$. In this case, as shown in FIG. 32, the molten metal shows little change in static pressure at its opposite side portions on the surface layer. Therefore, the mold tube 315 is provided only at its lower portion with an electromagnetic field generating means 380 including a core 378 and a coil 379 would thereon and an induced current absorbing plate 380'. As a result, an electromagnetic force oriented upwardly as indicated by a broken arrow shown in FIG. 32 acts on the lower portion of the molten metal 12. This compensates for the static pressure which is relatively small in value in the lower portion of the mold tube 315, thereby making it possible to obtain a substantially uniform static pressure distribution peripherally of the mold tube 315.

The embodiment shown in FIG. 33 is a modification of installation described by referring to FIG. 2 in which the electromagnetic field generating means 18 is mounted in enclosing relation to the tundish nozzle 14 and the mold 3 in the vicinity of the boundary 17 to reduce the transverse dimention of the molten metal flowing therein. In this modification, the mold tube 315 is provided with electromagnetic field generating means 334 located in enclosing relation, as is the case with the installation shown in FIG. 23.

In this installation, lubricant 46 is supplied to the surface of the molten metal 12 through the nozzle 42 from the ring-shaped header 41 located on the tundish nozzle 14. The pressure at which the molten metal 12 comes into contact with the inner surface of the mold tube 15 is rendered substantially uniform along the entire periphery by the electromagnetic field generating means 334 arranged in a manner to enclose the mold tube 315, so that the current of the lubricant 46 becomes substantially uniform peripherally and lubrication is effected with increased efficiency.

The hydraulic cylinder in the aforesaid embodiments for adjusting the positions in which electromagnetic field generating means are moved upwardly and downwardly may be pneumatic cylinder or motors. Also, in the aforesaid embodiments, the cross section of the tundish nozzle and the mold perpendicular to the axes thereof are shown as being rectangular or circular. However, the cross-sectional shapes of the tundish nozzle and the mold are not limited to the aforesaid specific shape.

According to the invention, the point at which the molten metal begins to come into contact with the inner surface of the mold is kept at the predetermined point, so that the length of a cooling zone in the mold is substantially constant, and a sound strand can be produced. Also, the point at which the molten metal begins to separate itself from the tundish nozzle is kept constant, so that it is possible to obtain a stable supply of lubricant. Furthermore, a substantially uniform contact pressure distribution between the inner surface of the mold and the molten metal can be obtained peripherally of the molten metal. This enables nonuniform cooling of the molten metal and deformation, crack formation and break-out of the strand to be prevented and allows nonsymmetrical wear on the inner surface of the mold to be avoided. When lubricant is supplied, the amount of the supplied lubricant becomes uniform peripherally of the molten metal and lubrication can be effected with increased efficiency.

What is claimed is:

1. A horizontal continuous casting method wherein electromagnetic field generating means is arranged in the vicinity of the boundary between a tundish nozzle and a mold, in order to apply an electromagnetic force to a molten metal flowing through the vicinity of the boundary to constrict the molten metal in the vicinity of the boundary, to thereby cause the molten metal to separate itself from the inner surface of the tundish nozzle anterior to the boundary and bring it into contact with the inner surface of the mold posterior to the boundary, said method comprising:

(a) sensing an actual point at which the molten metal begins to come into contact with the inner surface of said mold with respect to the flowing direction of the molten metal;

(b) comparing said actual point with a set point at which the molten metal is designed to begin to come into contact with the inner surface of said mold; and (c) applying a control signal corresponding to the difference of said actual point and said set point to said electromagnetic field generating means, to thereby control said electromagnetic field generating means to bring the point at which the molten metal begins to come into contact with the inner surface of the mold into coincidence with said set point.

2. A horizontal continuous casting method as claimed in claim 1, wherein the electromagnetic force is controlled by adjusting power supplied to the electromagnetic field generating means.

3. A horizontal continuous casting method as claimed in claim 1, wherein the electromagnetic force is controlled by adjusting the position of the electromagnetic field generating means along the horizontal axis of the tundish nozzle.

4. A horizontal continuous casting method wherein electromagnetic field generating means is arranged in the vicinity of the boundary between a tundish nozzle and a mold, in order to apply an electromagnetic force to a molten metal flowing through the vicinity of the boundary to constrict the molten metal in the vicinity of the boundary, to thereby cause the molten metal to separate itself from the inner surface of the tundish nozzle anterior to the boundary and bring it into contact with the inner surface of the mold posterior to the boundary, and being withdrawn from the outlet of the mold as a strand, said method comprising:

(a) sensing an actual value of surface temperature of the strand at the outlet of said mold;

(b) comparing said actual value with a set value thereof; and (c) applying a control signal corresponding to the difference of said actual value and said set value to said electromagnetic field generating means, to thereby control said electromagnetic field generating means to bring the point at which the molten metal begins to come into contact with the inner surface of the mold into coincidence with a preset point.

5. A horizontal continuous casting method wherein electromagnetic field generating means is arranged in the vicinity of the boundary between a tundish nozzle and a mold, in order to apply an electromagnetic force to a molten metal flowing through the vicinity of the boundary to constrict the molten metal in the vicinity of the boundary, to thereby cause the molten metal to separate itself from the inner surface of the tundish nozzle anterior to the boundary and bring it into contact with the inner surface of the mold posterior to the boundary, and being withdrawn from the outlet of the mold as a strand, said method comprising:

(a) sensing an actual value of thickness of solidified molten metal at the surface of the strand at the outlet of said mold;

(b) comparing said actual value with a set value thereof; and (c) applying a control signal corresponding to the difference of said actual value and said set value to said electromagnetic field generating means, to thereby control said electromagnetic field generating means to bring the point at which the molten metal begins to come into contact with the inner surface of the mold into coincidence with a preset point.

6. A horizontal continuous casting method wherein electromagnetic field generating means is arranged in the vicinity of the boundary between a tundish nozzle and a mold, in order to apply an electromagnetic force to a molten metal flowing through the vicinity of the boundary to constrict the molten metal in the vicinity of the boundary, to thereby cause the molten metal to separate itself from the inner surface of the tundish nozzle anterior to the boundary and bring same into contact with the inner surface of the mold posterior to the boundary, said method comprising:

(a) sensing actual points at which the molten metal begins to come into contact with the inner surface of said mold on its upper and lower portions respectively with respect to the flowing direction of the molten metal;

(b) comparing said actual points with a common set point at which the molten metal is designed to begin to come into contact with the inner surface of said mold along the entire inner periphery thereof; and (c) applying a control signal corresponding to the difference to said actual points and said set point to said electromagnetic field generating means, to thereby control said electromagnetic field generating means to bring the points at which the molten metal begins to come into contact with the inner surface of the mold into coincidence with said set point with respect to the flowing direction of the molten metal along the entire inner periphery of the mold.

7. A horizontal continuous casting method as claimed in claim 6, wherein the electromagnetic force is controlled by adjusting the vertical position of the electromagnetic field generating means perpendicular to the flowing direction of the molten metal.

8. A horizontal continuous casting method as claimed in claim 6, wherein the electromagnetic force is controlled by adjusting the angle of inclination of the electromagnetic field generating means about a horizontal axis perpendicular to the flowing direction of the molten metal.

9. A horizontal continuous casting method wherein electromagnetic field generating means is arranged in the vicinity of the boundary between a tundish nozzle and a mold, in order to apply an electromagnetic force to a molten metal flowing through the vicinity of the boundary to constrict the molten metal in the vicinity of the boundary, to thereby cause the molten metal to separate itself from the inner surface of the tundish nozzle anterior to the boundary and bring it into contact with the inner surface of the mold posterior to the boundary, and being withdrawn from the outlet of the mold as a strand, said method comprising:

(a) sensing actual values of surface temperature of the strand on its upper and lower portions respectively at the outlet of said mold;

(b) comparing said actual values with a common set value of surface temperature of the strand along the entire outer periphery at the outlet of said mold; and (c) applying a control signal corresponding to the difference of said actual values and said set value to said electromagnetic field generating means, to thereby control said electromagnetic field generating means to bring the points at which the molten metal begins to come into contact with the inner surface of the mold into coincidence with a preset point with respect to the withdrawing direction of the strand along the entire inner periphery of the mold.

10. A horizontal continuous casting method wherein electromagnetic field generating means is arranged in the vicinity of the boundary between a tundish nozzle and mold, in order to apply an electromagnetic force to a molten metal flowing though the vicinity of the boundary to constrict the molten metal in the vicinity of the boundary, to thereby cause the molten metal to separate itself from the inner surface of the tundish nozzle anterior to the boundary and bring same into contact with the inner surface of the mold posterior to the boundary, and being withdrawn from the outlet of the mold as a strand, said method comprising:

(a) sensing actual values of thickness of solidified molten metal at the surface of the strand on its upper and lower portions respectively at the outlet of said mold;

(b) comparing said actual values with a common set value of thickness of solidified molten metal at the surface of the strand along the entire outer periphery at the outlet of said mold; and (c) applying a control signal corresponding to the difference of said actual values and said set value to said electromagnetic field generating means, to thereby control said electromagnetic field generating means to bring the points at which the molten metal begins to come into contact with the inner surface of the mold into coincidence with a preset point with respect to the withdrawing direction of the strand along the entire inner periphery of the mold.

11. A horizontal continuous casting method of continuously feeding molten metal stored in a tundish through a tundish nozzle which is located at a side surface near the bottom thereof to a mold horizontally connected to the tundish nozzle to cast the molten metal to produce a strand which is withdrawn, characterized in that an electromagnetic field generating means is arranged around a mold tube of said mold to give a centripetal force to said molten metal flowing through said mold, and comprising the steps of:

(a) sensing values of surface temperature of the strand at several points along the periphery thereof;

(b) comparing said sensed values with each other; and (c) applying control signals corresponding to the differences between said sensed values to a control means to adjust the vertical position of said electromagnetic field generating means perpendicular to the withdrawing direction of the strand to thereby enable uniform contact pressure between the inner surface of the mold and the molten metal to be obtained along the entire periphery thereof.

* * * * *